US006160533A

United States Patent [19]

Tamai et al.

[11] Patent Number: 6,160,533

[45] Date of Patent: Dec. 12, 2000

[54] METHOD AND APPARATUS FOR DRIVING DISPLAY PANEL

[75] Inventors: Shigeki Tamai, Kashihara; Tomoaki Nakao, Yamatokoriyama, both of Japan

[73] Assignee: Sharp Kabushiki Kaishi, Osaka, Japan

[21] Appl. No.: 08/659,750

[22] Filed: Jun. 6, 1996

[30] Foreign Application Priority Data

Jun. 19, 1995 [JP] Japan ..... 7-151764
Nov. 16, 1995 [JP] Japan ..... 7-298770

[51] Int. Cl.[7] ..... G09G 3/36

[52] U.S. Cl. ..... 345/89; 345/95; 345/99

[58] Field of Search ..... 345/87, 88, 89, 345/92, 95, 94, 99, 100

[56] References Cited

U.S. PATENT DOCUMENTS 5,264,839 11/1993 Kanno et al. ..... 345/98
5,266,936 11/1993 Saitoh ..... 345/98
5,414,443 5/1995 Kanatani et al. ..... 345/89
5,523,772 6/1996 Lee ..... 345/98
5,534,885 7/1996 Saitoh ..... 345/100
5,583,535 12/1996 Takarada et al. ..... 345/99
5,642,127 6/1997 Tamai .
5,828,357 10/1998 Tamai et al. .
5,917,238 6/1999 Tamai .
6,002,384 12/1999 Tamai et al. .

FOREIGN PATENT DOCUMENTS 4-214594 8/1992 Japan .
5-297833 11/1993 Japan .
750389 5/1995 Japan .

*Primary Examiner*—Kent Chang

[57] ABSTRACT

A reference voltage having a plurality of voltage levels which increase stepwise over time is supplied to source lines on a display panel through a plurality of analog switches. A value representing a number of gradation display data levels for the source lines during a horizontal scanning period is supplied as one input in to a comparison circuit. A count registered by a counter and representing a gradation clock signal is supplied as a second input. Where the count is less than the value, the analog switches remain conducted. Once the count equals to or exceeds the value, the analog switches are cut off, thus enabling the supplied reference voltage to be applied as a driving voltage to a pair of pixel electrodes. The driving voltage corresponds to the number of gradation display data levels and is held constant at the pixel electrodes for the remaining horizontal scanning period.

21 Claims, 22 Drawing Sheets

FF1
FF2
FF3
FF4
FF5
FF6
FF7
FF8
D
Q
CK
61
41
63
out
AS1
AS2
AS3
AS4
AS5
AS6
AS7
AS8
R1
R2
R3
R4
R5
R6
R7
62
64
AS11
AS12
66
AS13
65
AS14
LATCH SIGNAL
LS
CK
POLARITY
INVERSION
VCC
VAA

METHOD AND APPARATUS FOR DRIVING DISPLAY PANEL

BACKGROUND OF THE INVENTION

1. Field of the Invention

The present invention relates to a method and apparatus for driving a display panel such as an active matrix type liquid crystal display panel.

2. Description of the Related Art

A first typical prior art method for driving a display is shown in FIG. 17. In an active matrix liquid crystal display panel 11 which forms a display apparatus 10, source lines O1 to ON and gate lines L1 to LM are formed in a matrix form and thin film transistors T are disposed at intersections of the source lines and the gate lines. Voltages from the source lines O1 to ON are selectively supplied to pixel electrodes P through the transistors T.

The source lines O1 to ON are connected to a source driver 12 composed of a semiconductor integrated circuit. The source driver 12 supplies one of eight types of reference voltages V0 to V7 which are supplied from a reference voltage source 13 to the source lines O1 to ON through terminals S1 to SN, in accordance with display data D0 to D2 consisting of three bits which respectively correspond to the source lines Ok (k=1 to N). A gate driver 14 composed of a semiconductor integrated circuit outputs gate signals G1 to GM to the gate lines L1 to LM. In one horizontal scanning period, the source driver 12 provides each source line Ok with a reference voltage which is based on the display data D0 to D2 which correspond to the respective pixel electrodes P each receiving each gate signal Gj (j=1 to M).

FIG. 18 is a block diagram specifically showing a partial structure of the source driver 12 of FIG. 17. The source driver 12 comprises decoder circuits FRk (k=1 to N) each corresponding to each one of the source lines O1 to ON. In response to data d0 to d2 corresponding to the display data D0 to D2, the source driver 12 selectively supplies the eight types of the reference voltages V0 to V7 from the reference voltage source 13 to the source line Ok through analog switches ASW0 to ASW7, thereby realizing 8-gradation display.

According to FIGS. 17 and 18, in the source driver 12, the reference voltages V0 to V7 corresponding to the respective gradation levels are independently supplied from the reference voltage source 13. The source driver 12 must comprise the same number of connection terminals as the reference voltages so as to receive the reference voltages V0 to V7 at the connection terminals, and further, the source driver 12 must comprise the analog switches ASW0 to ASW7 which correspond to the respective gradation levels so as to output the reference voltages.

The analog switches ASW0 to ASW7 disposed within the source driver 12 must have sufficiently low ON-resistances, so that the level of a selected one of the reference voltages V0 to V7 is accurately written in each one of the source lines O1 to ON of the display panel 11 which are connected externally to the source driver 12. Hence, in general, the area needed to dispose the analog switches ASW0 to ASW7 within a semiconductor chip must be approximately ten times as large as that in a logic circuit element which is ON/OFF-controlled for the purpose of a logic operation within the source driver 12.

Due to this, the analog switches ASW0 to ASW7 occupy a large area within the area in which the semiconductor chip set of the source driver 12 is formed. Therefore, an increase in the number of the analog switches ASW0 to ASW7 to realize an increased number of gradation levels directly results in an increase in the size of the semiconductor chip.

While a semiconductor chip set such as the source driver 12 has been improved over the recent years to reduce the chip size, there is a limit in reducing the size of a terminal itself. A reduction in the number of connection terminals is therefore desired. Further, it is desired to reduce the number of the analog switches ASW0 to ASW7 which are included in the source driver 12, for instance, to thereby reduce the chip size of the source driver 12 which is formed by a semiconductor integrated circuit and to reduce a cost.

In the first prior art, method when 16-level gradation display is to be realized using 4-bit display data, for example, connection terminals for receiving reference voltages to generate sixteen types of voltages are necessary, and further, sixteen analog switches in total each corresponding to each one of the reference voltages are necessary. Hence, in reality, it is impossible to perform mass production of the source driver 12 for conducting higher level gradation display, such as 64-level gradation display and 256-level gradation display.

As a second prior art, method Japanese Unexamined Patent Publication JP-A 4-214594 (1992) discloses an arrangement which reduces the number of connection terminals for reference voltages and the number of analog switches to thereby reduce the size of a semiconductor chip. FIG. 19 shows a schematic structure of a display apparatus disclosed in JP-A 4-214594.

Of a pair of substrates which face each other through liquid crystal, one substrate comprises pixel electrodes 16, drain lines 17, gate lines 18, and switching elements 19 which are disposed at intersections of the drain lines 17 and the gate lines 18 to supply voltages at the drain lines 17 to the pixel electrodes 16. In the other substrate, data electrodes 20 each extending in a vertical direction in FIG. 19 are formed to correspond to the respective rows.

A control pulse is supplied to the gate lines 18 so that a scanning circuit 21 defines a horizontal scanning period. During the horizontal scanning period, a reference gradation signal whose voltage varies at a constant ratio is applied to the pixel electrodes 16 through the drain lines 17. That is, a reference gradation signal circuit 23 supplies a voltage having a ramp waveform whose level increases or decreases with time within the horizontal scanning period, commonly to the drain lines 17. A data signal supply circuit 22 provides the data electrodes 20 with a data signal whose voltage level remains finalized at only during a period which corresponds to the gradation level of the data signal but becomes an high-impedance condition during other periods. In short, the data electrodes 20 receive a voltage whose level remains finalized only during a period which corresponds to the gradation level, so that the gradation level is adjusted by the length of the period during which the voltage level at the data electrodes 20 remains finalized.

The second prior art display apparatus described above has a big problem that it is necessary to dispose a large number of the data electrodes 20 which are divided into the rows in the other one of the substrates. The other one of the substrates which is disposed to face the pixel electrodes 16 of a liquid crystal display panel which is widely used in general at present includes only one common electrode which is formed all over these large number of pixel electrodes 16. Hence, the display panel itself must be re-designed to implement this prior art arrangement. Thus, it is difficult to implement this prior art arrangement.

Further, since the second prior art arrangement requires that the gradation levels are held on the data electrodes 20 side, it is impossible to utilize an auxiliary capacity for holding data which is conventionally often formed in the one substrate of the display panel.

Meanwhile, Japanese Unexamined Patent Publication JP-A 5-297833 (1993) discloses a third prior art method and apparatus for driving display. FIG. 20 shows a schematic structure of this prior art arrangement. A shift register 27 controls the timing of writing input data for colors R, G and B each consisting of 4 bits within a data register 28, in accordance with a clock signal CLK. Upon writing one line of input data in the data register 28, the shift register 27 transmits the written one line of input data to a data latch circuit 29 in a parallel manner so that the one line of input data is held at the data latch circuit 29.

The data held at the data latch circuit 29 are supplied to a comparison part 30 at predetermined timing. The comparison part 30 compares the data supplied from the data latch circuit 29 with a 4-bit count supplied from a 4-bit counter 31 for each one of the colors R, G and B, and supplies a result of the comparison to a selector-incorporated sample and hold circuit 32. Step wave voltages VR and VB whose levels respectively change in eight and two levels are also supplied to the selector-incorporated sample and hold circuit 32 from step wave voltage circuits 33 and 34.

Using a sample and hold capacitor which is incorporated therein, the selector-incorporated sample and hold circuit 32 performs sampling and holding on a level signal supplied from the step wave voltage circuits 33 and 34 corresponding to the result of the comparison which is yielded by the comparison part 30. Receiving a voltage VDD, an output buffer 35 outputs a signal voltage, which corresponds to a charging voltage level which is charged in the capacitor which is incorporated in the selector-incorporated sample and hold circuit 32, for each one of the colors R, G and B, so that the signal voltage is supplied to the lines for every row.

In the third prior art, apparatus the selector-incorporated sample and hold circuit 32 includes the sample and hold capacitor, and an operational amplifier which is formed in each line within the output buffer 35 causes a voltage follower to output a potential which is determined by a charge which is accumulated in the capacitor. Hence, outputs from the step wave voltage circuits 33 and 34 are supplied only to the capacitor of the selector-incorporated sample and hold circuit 32, but are not supplied directly to the lines of the display panel. Since voltages which are supplied to the lines of the display panel are voltages which are amplified by operational amplifiers which are disposed within the output buffer 35, a variation in characteristics of the operational amplifiers undesirably change the voltages which are supplied to the lines, and hence, deteriorates the quality of displaying. The characteristics of the operational amplifiers vary when there is a deviation of output voltage because of a variation in input offset voltage, when an output voltage range becomes narrow due to a limited dynamic range of the operational amplifiers.

Further, Japanese Examined Patent Publication JP-B2 7-50389 (1995) discloses a fourth prior art method and apparatus for driving a display. FIG. 21 is a block diagram showing the structure of an X-driver 120 for driving source electrodes disclosed in the prior art. FIG. 22 is a timing chart of signals which are used in the X-driver 120.

A shift register 121 controls the timing of 4-bit writing data input signals PD1 to PD4 in four half latches 129 of a latch A-circuit 122, in accordance with a start pulse XSP and a clock signal XCL. The latch A-circuit 122 includes M pairs of the four half latches 129. When the M pairs of the half latches 129 hold data, a latch clock signal LCL as that shown in FIG. 22 is supplied to half latches 130 of a latch B-circuit 123, whereby the data are held.

A 4-bit binary counter 124 is reset by the latch signal LCL and counts a gradation basic signal F16 as that shown in FIG. 22. M comparison elements 138 of a comparator 125 receive outputs QA to QD from the binary counter 124 and outputs from the half latches 130, and supplies a result of comparison as an output signal Y as that shown in FIG. 22 to an input D of a D flip-flop 126. The D flip-flop 126 receives outputs from the comparison elements 138 in synchronization to a rise of the gradation basic signal F16. The D flip-flop 126 is set by the latch signal LCL and reset by a stop signal STOP. An output from the D flip-flop 126 is increased up to such a voltage with which a level shifter 127 can drive an analog switch 128.

A video voltage VID as that shown in FIG. 22 is supplied to the analog switch 128, and the analog switch 128 is opened and closed under the control of an output from the level shifter 127. The video voltage VID linearly varies from an OFF-level voltage VOFF to an ON-level voltage VON of liquid crystal, during one horizontal scanning period TH.

As the analog switch 128 is opened and closed, the video voltage VID which varies in the manner described above is applied to pixel electrodes of a liquid crystal display panel through source signal lines, as a voltage VPIX as that shown in FIG. 22. The voltage VPIX is held from a time ta at which the gradation basic signal F16 rises after the output signal Y falls until a time tb at which the horizontal scanning period TH ends.

Since the fourth prior art apparatus requires that the video voltage VID which is supplied to source electrodes through the analog switch 128 has a linear sawtooth waveform, when the timing at which the comparison elements 138 outputs an output signal is subtly shifted, a voltage at this timing is held. This deteriorates the quality of displaying.

SUMMARY OF THE INVENTION

An object of the invention is to provide a method and apparatus for driving a display panel in which higher level gradation is realized while the number of connection terminals and analog switches is reduced so that it is possible to reduce the size of a semiconductor chip, preferably the size of a source driver, reduce consumption of current and cost, and to increase the density of mounting.

Another object of the invention is to provide a method and apparatus for driving a display panel, which reduce the number of connection terminals and analog switches while utilizing a display panel widely used now in which one of a pair of substrates comprises a number of pixel electrodes and the other substrate of the pair of substrates facing the one substrate of the pair of substrates through a dielectric layer such as a liquid crystal layer comprises only one common electrode.

Still another object of the invention is to provide a method and apparatus for driving a display panel, which reduce the size of a semiconductor chip such as a source driver and reduce the consumption current without using a complex circuit structure such as the use of operational amplifiers unlike in the prior art which has been described with reference to FIG. 20, and while preventing deterioration in display quality due to a variation in characteristics of such semiconductor elements.

The invention provides a method of driving a display panel in which gradation display is conducted by applying a voltage between a pair of electrodes facing each other through a dielectric layer, the method comprising the steps of:

generating a voltage whose level varies stepwise with time, at intervals of a period and applying the voltage of a level of the time when a time corresponding to gradation display data elapsed, to the electrodes at intervals of the predetermined period and holding the voltage in the dielectric layer between the electrodes.

The invention provides a method of driving a display panel in which gradation display is conducted by applying a voltage between a pair of electrodes facing each other through a dielectric layer, the method comprising the steps of:

generating a voltage whose level varies stepwise with time, at intervals of a predetermined period and applying the voltage of a level corresponding to gradation display data when the voltage reaches the level, to the electrodes at intervals of the predetermined period and holding the voltage in the dielectric layer between the electrodes.

According to the invention, a voltage whose level increases or decreases stepwise with time is generated periodically, and gradation display is conducted by applying the voltage of a level of the time when a time corresponding to gradation display data elapsed, or the voltage of a level corresponding to gradation display data when the voltage reaches the level, to the electrodes of the display panel at intervals of the predetermined period. Hence, multi-level gradation display is conducted without increasing the number of terminals to which the voltage is inputted and the number of switching elements for applying the voltage to the electrodes, resulting in reducing the display apparatus structure in size. Further, since the number of the switching elements for applying the voltage to the electrodes while performing multi-level gradation display is reduced, it is possible to reduce the size, consumption current and cost of the semiconductor chip and increase the density of mounting.

Further, the invention is easily embodied because a prior display panel in which one substrate of a pair of substrates including a large number of pixel electrodes is faced with the other substrate of the pair of substrates including only one common electrode through a dielectric layer disposed between the same can be used without modification.

It is convenient that the invention can be embodied using the conventional display panel without modification in such a constitution that an auxiliary capacitor is formed between each of lines such as source lines to which a thin film transistor (hereinafter abbreviated as TFT) such as a metal oxide semiconductor field effective transistor (hereinafter abbreviated as MOS-FET), which is a pixel switching element, is connected, and a gate line beyond the gate line to which the gate of the TFT is connected, by one line in a time-sequential scanning direction, in order to increase the capacities of the pixel electrodes connected to the TFTs to hold voltages corresponding to gradation levels.

According to the invention, complex circuits such as operational amplifiers as described in relation to the prior art are not required. This contributes to reduction of the size and consumption current of the semiconductor chip, too.

While in the invention a liquid crystal material is used for the dielectric layer of the display panel, other materials such as an electroluminescence (abbreviated as "EL") material may be used.

The invention is applied not only to an active matrix type liquid crystal display panel in which pixel switching elements such as TFTs are used, but also to a so-called simple matrix type liquid crystal display panel in which electrodes are arranged to face each other in a matrix form, for example, through a dielectric layer. The invention is also applied to display panels having other structures.

The invention provides a method for driving a display panel in which gradation display is conducted by applying a voltage between a pair of electrodes facing each other through a dielectric layer, the method comprising the steps of:

generating a first voltage whose level increases stepwise with time from a first potential to a second potential and a second voltage whose level decreases stepwise with time from the second potential to the first potential and outputting the first and the second voltage alternately at intervals of a predetermined period, applying the first or the second voltage of a level of the time when a time corresponding to gradation display data elapsed, to one of the pair of electrodes at intervals of the predetermined period, and applying the first potential to the other electrode of the pair of electrodes in case where the first voltage is applied to the one electrode of the pair of electrodes and the second potential in case where the second voltage is applied to the one electrode of the pair of electrodes, to the other electrode of the pair of electrodes, and holding the applied voltage in the dielectric layer between the electrodes.

The invention provides a method for driving a display panel in which gradation display is conducted by applying a voltage between a pair of electrodes facing each other through a dielectric layer, the method comprising the steps of:

generating a first voltage whose level increases stepwise with time from a first potential to a second potential and a second voltage whose level decreases stepwise with time from the second potential to the first potential and outputting the first and the second voltage alternately at intervals of a predetermined period, applying alternately the first and the second voltage of the time when a time corresponding to gradation display data elapsed, to one electrode of the pair of electrodes via respective signal lines provided for the purpose of application of the voltage to the electrodes, and applying a predetermined reference voltage to the other electrode of the pair of electrodes and holding the voltage between the electrodes.

Generally, in driving of a display panel including a dielectric layer formed by liquid crystal, when a direct current voltage is applied to the liquid crystal for a long time, the liquid crystal is deteriorated and hence the quality of displaying is lowered. Hence, alternating drive which changes the direction of applying a voltage at intervals of a constant period is employed in driving of such a display panel.

According to the invention, the voltage whose level increases stepwise with time from the first potential to the second potential and the voltage whose level decreases stepwise with time from the second potential to the first potential are alternately generated at intervals of a period, and the voltage of a level corresponding to gradation display data is applied to the one electrode of the pair of electrodes of the display panel. When the voltage level increases, the first potential is applied to the other electrode of the pair of electrodes, but the second potential is applied to the other electrode of the pair of electrodes when the voltage level decreases. Thus, the voltage is held in the dielectric layer disposed between one electrode and the other electrode. This allows to realize multilevel gradation display in an alternate current manner, by supplying the voltage generated periodically to a driving apparatus which drives the one electrode and selectively applying the first and the second voltage to the other electrode. Hence, the driving apparatus includes a smaller number of terminals which receive the reference voltage than a conventional driving apparatus which realizes the same gradation display.

As a method of alternating driving, such a manner may be used that the first voltage whose level increases stepwise with time from a predetermined reference voltage at intervals of a predetermined period and the second voltage whose level decreases stepwise with time from the predetermined reference voltage at intervals of a predetermined period are switched at intervals of a predetermined period and the voltage is supplied to the signal lines which are disposed to apply the voltages to the one electrode to apply the voltage at a time corresponding to gradation display data may be applied to the one electrode while the reference voltage is applied to the other electrode.

The invention is characterized by comprising the steps of:

generating more number of gradation clock signals than the number of gradation levels to be gradation-displayed sequentially with time at intervals of a predetermined period, counting the gradation clock signals, and applying a voltage of a level of the time when a count reaches a value corresponding to gradation display data to the electrodes, and rendering the electrodes to hold the voltage.

According to the invention, more number of gradation clock signals than the number of gradation levels are generated at intervals of a predetermined period and the gradation clock signals are counted. When the count reaches a value corresponding to the gradation display data, the voltage whose level varies periodically is applied to the electrodes. Hence, it is possible to apply a voltage of a level corresponding to the gradation display data to the electrodes without fail, and to conduct gradation display based on the gradation display data.

The invention provides a driving apparatus for conducting gradation display by applying a voltage supplied from a voltage source, to a pair of electrodes through a dielectric layer, the driving apparatus comprising:

a voltage applying switching element for controlling voltage to be applied to the electrodes;

a gradation display data generating device for generating gradation display data at intervals of a predetermined period;

a timing device for measuring time every period; and a switching element control device for controlling turning on and off of the voltage applying switching element in response to respective outputs from the gradation display data generating device and the timing device, wherein to the voltage applying switching element is given a voltage whose level increases or decreases stepwise with the time of voltage generation at intervals of the predetermined period by a voltage source.

According to the invention, every period such as a horizontal scanning period set for the display panel, the voltage source generates a voltage whose level increases or decreases stepwise with time and supplies the same to the voltage applying switching element. A time corresponding to the gradation display data generated by the gradation display data generating device at intervals of a predetermined period is measured by the timing means. In response to outputs from the gradation display data generating device and the timing device, the switching element control device controls the voltage applying switching element so that voltage whose level corresponds to the gradation display data is applied to the electrodes of the display panel and held thereat. Hence, by controlling the voltage applying switching element at the timing corresponding to the gradation display data, it is possible to conduct gradation display based on the gradation display data by means of the voltage whose level varies stepwise, and it is possible to reduce the number of terminals for receiving the reference voltage, disposed in a driving apparatus for driving the display panel. Further, as far as there is disposed one voltage applying switching device such as an analog switch, the voltage applying switching device can supply the voltage corresponding to the gradation display data to the electrodes. Hence, the area in which the driving apparatus is formed is reduced. Still further, voltage from the voltage source is supplied to pixel electrodes through pixel switching elements, on a line such as a source line of the display panel which carries the voltage from the voltage source through the voltage applying switching element. That is, since charging and discharging are performed with voltage directly applied to electrodes such as pixel electrodes, the structure is simpler than in the prior arts described above. This eliminates the need to dispose a capacitor for sampling and holding, etc., separately.

The invention is characterized in that the timing device includes:

a gradation clock signal generating device for generating gradation clock signals in time sequence at intervals of the predetermined period, the number of the gradation clock signals being larger than the number of gradation levels which are to be displayed gradationally during the predetermined period; and a counter for adding the gradation clock signals and yielding a count, and the switching element control device controls turning-on and -off of the voltage applying switching element when a count of the counter reaches a value corresponding to gradation display data fed from the gradation display data generating device.

Further, the invention provides an apparatus for driving a display panel in which gradation display is conducted by applying voltage between a pair of electrodes facing each other through a dielectric layer, the driving apparatus comprising:

gradation display data generating device for generating gradation display data at intervals of a predetermined period;

the timing device including gradation clock signal generating device for generating gradation clock signals in time sequence at intervals of the predetermined period, the number of the gradation clock signals being larger than the number of gradation levels which are to be displayed gradationally during the predetermined period and a counter for adding the gradation clock signals and yielding a count, a voltage applying switching element for controlling a voltage to be applied to the electrodes;

switching element control device for generating a voltage whose level increases or decreases stepwise, on the basis of the count of the counter, supplying the voltage to the voltage applying switching element, and controlling turning-on and -off of the voltage applying switching element in response to outputs from the gradation display data generating device and timing device.

According to the invention, the voltage from the switching element control device which increases or decreases stepwise with time is applied to the electrodes of the display panel through the voltage applying switching element. The switching element control device which receives outputs from the gradation display data generating device and the timing device controls electrical conduction/interruption of the voltage applying switching element in such a manner that a voltage level corresponding to gradation display data is applied to the voltage applying switching element. Accordingly, one type of voltage whose level varies stepwise suffices the voltage which is supplied from the voltage source to a driving apparatus. This reduces the number of terminals for receiving the reference voltage which are disposed in the driving apparatus.

The invention is characterized in that the switching element control device allows electrical conduction of the voltage applying switching element when the count of the counter is smaller than a value corresponding to gradation display data, and electrically interrupts the voltage applying switching element when the count of the counter becomes equal to or larger than the value corresponding to gradation display data.

Further, the invention is characterized in that the switching element control device allows electrical conduction of the voltage applying switching element for a predetermined period when the count of the counter reaches the value corresponding to gradation display data, and rendering the electrodes to hold the voltage of the level of the time of the electrical conduction.

Further, the invention is characterized in that the timing device includes gradation clock signal generating device for generating gradation clock signals in time sequence at intervals of the predetermined period, the number of the gradation clock signals being larger than the number of gradation levels which are to be displayed gradationally during the predetermined period; and the switching element control device includes a backward counter for setting a value corresponding to the gradation display data at intervals of the predetermined intervals, and subtracting the value every time when a gradation clock signal is received, and when a value of the backward counter reaches a predetermined value, controls turning-on and -off of the voltage applying switching element.

According to the invention, the timing device may be a counter which adds gradation clock signals having a shorter period than said period and yields a count, and may be a backward counter which subtracts from a count corresponding to gradation display data. By controlling the electrical conduction/interruption of the voltage applying switching element in response to an output from the timing device, a voltage whose level varies stepwise can be securely applied to the display panel when the level of the voltage is a desired level corresponding to gradation display data.

The invention is characterized in that the switching element control device includes a backward counter for setting a value corresponding to the gradation display data at intervals of the predetermined intervals, and subtracting the value every time when a gradation clock signal is received, and when a value of the backward counter reaches a predetermined value, controls turning-on and -off of the voltage applying switching element.

Further, the invention is characterized in that the switching element control device maintains the electrical conduction of the voltage applying switching element when the count of the backward counter is larger than the predetermined count, and interrupts the electrical conduction of the voltage applying switching element when the count of the backward counter becomes equal to or smaller than the predetermined count.

Further the invention is characterized in that the switching element control device allows electrical conduction of the voltage applying switching element for a predetermined period when the count of the backward counter reaches the predetermined value, and rendering the electrodes to hold the voltage during the electrical conduction.

According to the invention, the voltage applying switching element may be constituted so as to be electrically conducted for a predetermined period when a count of the counter reaches a value corresponding to gradation display data or when a count of the backward counter reaches the predetermined valve, such as zero, and to render the electrodes such as pixel electrodes to hold the voltage during the time of the electrical conduction.

Further, the invention is characterized in that the switching element control device includes a digital-to-analog convertor for generating a voltage whose level varies stepwise on the basis of outputs from the counter.

The invention provides a display apparatus comprising:

a display panel in which driving voltages supplied via first lines are supplied via pixel switching elements which are electrically conducted by pixel control signals supplied via second lines to pixel electrodes disposed at intersections of the first and second lines which are arranged in the form of a matrix, a constant voltage which serves as a reference is applied to a common electrode disposed to face the pixel electrodes, and potential differences between the pixel electrodes and the common electrode are provided, whereby gradation display is conducted;

a gate driver for supplying the pixel control signal to the respective second lines sequentially within a plurality of predetermined horizontal scanning periods, and rendering the pixel switching elements connected to the second lines to which the pixel control signal has been supplied, to electrically conduct;

gradation display data generating means for sequentially deriving gradation display data for each one of the first lines, in the form as serial bits, during the horizontal scanning period;

a data latch circuit for deriving the gradation display data from the gradation display data generating means by latching as parallel bits every horizontal scanning period;

a voltage source for generating voltages which increase or decrease stepwise with time every horizontal scanning period;

a voltage applying switching element disposed between the voltage source and the pixel electrodes;

a timing device for measuring the duration of horizontal scanning period every horizontal scanning period; and switching element control device for controlling turning-on and -off of the voltage applying switching element in response to outputs from the gradation display data generating device when a time corresponding to gradation display data elapsed, whereby the voltage is applied to the electrodes so as to hold the voltage.

The invention provides a display apparatus comprising:

a display panel in which driving voltages supplied via first lines are supplied via pixel switching elements which are electrically conducted by pixel control signals supplied via second lines to pixel electrodes disposed at intersections of the first and second lines which are arranged in the form of a matrix, a constant voltage which serves as a reference is applied to a common electrode disposed to face the pixel electrodes, and potential differences between the pixel electrodes and the common electrode are provided, whereby gradation display is conducted;

a gate driver for supplying the pixel control signal to the respective second lines sequentially within a plurality of predetermined horizontal scanning periods, and rendering the pixel switching elements connected to the second lines to which the pixel control signal has been supplied, to electrically conduct;

a gradation display data generating device for sequentially deriving gradation display data for each one of the first lines, in the form as serial bits, during the horizontal scanning period;

a data latch circuit for deriving the gradation display data from the gradation display data generating means by latching as parallel bits every horizontal scanning period;

a voltage applying switching element for controlling voltages to be supplied to the pixel electrodes;

a gradation clock signal generating device for generating gradation clock signals in time sequence at intervals of the predetermined period, the number of the gradation clock signals being larger than the number of gradation levels which are to be displayed gradationally during the predetermined period;

a counter for adding the gradation clock signals and yielding a count, and a switching element control device for generating a voltage whose level increases or decreases stepwise on the basis of a count of the counter and supplying the voltage to the first lines, controlling turning-on and -off of the voltage applying switching element when a time corresponding to gradation display data elapsed, whereby the voltage is applied to the electrodes, which are rendered to hold the voltage.

According to the invention, the gradation clock signals which are generated sequentially with time are added into a count by the counter, a voltage whose level increases or decreases stepwise is generated on the basis of a count of the counter every predetermined period, and the voltage is applied to the electrodes of the display panel through the voltage applying switching element. The switching element control device which receives outputs from the gradation display data generating device controls conduction/interruption of the voltage applying switching element so that a voltage of a value corresponding to gradation display data is applied to the voltage applying switching element, thereby realizing gradation display at the display panel. Since the reference voltage to be applied to the electrodes of the display panel for the purpose of gradation display is generated within the driving apparatus, it is possible to reduce the number of terminals for receiving the reference voltage, disposed in the driving apparatus. The voltage applying switching element is conducted, for example, at the start of the period and interrupted when the voltage value corresponding to gradation display data is reached. Alternatively, the voltage applying switching element may be conducted and the voltage is applied when the voltage level corresponding to gradation display data is reached, and interrupted after the voltage was applied. Further, since the voltage varies stepwise exactly in synchronization to the gradation clock signals, it is possible to apply a desired voltage of a level which is desired for the purpose of gradation display to the electrodes of the display panel exactly.

A time corresponding to gradation display data is equivalent to a value corresponding to gradation display data of a voltage whose level varies with time.

As described above, according to the invention, a voltage whose level periodically increases or decreases stepwise is generated, the voltage at the time when a time corresponding to gradation display data elapsed or when the voltage reaches a level corresponding to gradation display data is applied to the electrodes and the voltage is held by the electrodes. Hence, the driving apparatus does not have to comprise a plurality of terminals which receive the voltage, but rather may comprise only one terminal for receiving the voltage. In addition, only one voltage applying switching element such as an analog switch may be disposed for each line such as a source line. This reduces the number of connection terminals and analog switches while realizing gradation display. Since this makes possible to reduce the size of a semiconductor chip such as a source driver, a consumption current and a cost and to increase the density of mounting, it is easy to perform mass production of semiconductor integrated circuit, such as a source driver, which realizes multilevel gradation display.

Further, the invention can be implemented using a conventional display panel in which one substrate including a large number of pixel electrodes is faced with the other substrate including only one common electrode which is common to the large number of pixel electrodes with a dielectric layer disposed between the same. Therefore, the invention creates an excellent effect that it is easily applied to a conventional display panel.

Still further, according to the invention, it is not necessary to dispose a sample and hold capacitor which has been described with reference to FIG. 20, nor to use complex circuits such as operational amplifiers. This contributes to a reduction in the size of the structure. This is one of important effects of the invention where the invention is realized by a semiconductor integrated circuit.

Still further, according to the invention, since the structure is simplified as described above, a variation in characteristics of the circuit elements is suppressed, which in turn improves the quality of displaying.

Still further, according to the invention, the gradation clock signal generating means generates more gradation clock signals, each having a shorter period than the period above, than the number of gradation levels which are to be displayed every period such as a horizontal scanning period, and the gradation clock signals are added up by the counter. When a count of the counter reaches a value which corresponds to gradation display data, the voltage applying switching element is turned on or off under control. Hence, it is possible to apply a voltage whose level corresponds to the gradation display data to the electrodes of the display panel without fail. Gradation display is realized as in prior art display systems, while simplifying the structure, e.g., by reducing the number of the terminals which receive the voltage and the voltage applying switching element.

Still further, according to the invention, a value which corresponds to gradation display data is set in the backward counter and decrement is performed every time the gradation clock signal is received, for period such as a horizontal scanning period. When the decrement count reaches a predetermined count, e.g., zero, conduction/interruption of the voltage applying switching element is controlled. This makes it possible to apply a voltage whose level corresponds to the gradation display data to the electrodes of the display panel without fail, and therefore, to simplify the structure as described above.

Still further, according to the invention, the voltage source for generating a voltage whose level increases or decreases stepwise with time can be realized by a digital-to-analog convertor which generates a voltage based on a count of the counter which counts and outputs the gradation clock signals supplied from the gradation clock signal generating means. Hence, it is easy to obtain a voltage whose level changes stepwise accurately in synchronization to the gradation clock signals, and to apply a voltage whose level corresponds to the gradation display data to the electrodes of the display panel at accurate timing.

Still further, according to the invention, gradation display is driven while using a dielectric layer such as liquid crystal and a electroluminescence material and utilizing charging/discharging of a charge at the electrodes of an active matrix type liquid crystal display panel, simple matrix type liquid crystal display panel, etc. Hence, it is possible to hold a voltage whose level corresponds to gradation display data without separately preparing a capacitance which tends to be large.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
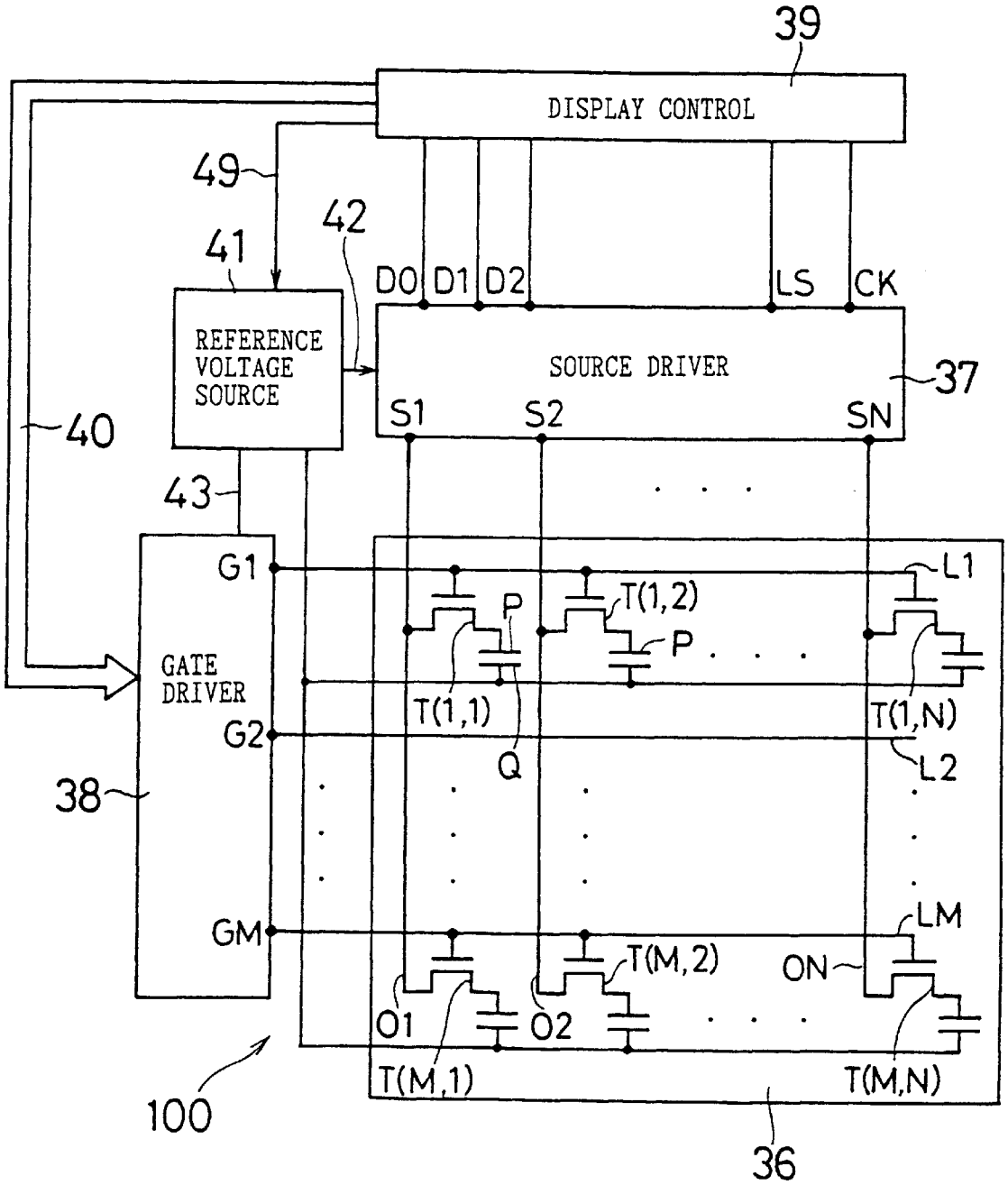
FIG. 1 is a block diagram showing an overall structure including a first embodiment of the present invention.

Now referring to the drawings, preferred embodiments of the invention are described below.

FIG. 1 is a block diagram showing a structure of a liquid crystal display apparatus 100, for describing a first embodiment of the present invention.

In an active matrix type liquid crystal display panel 36, source lines O1 to ON which serve as first lines and gate lines L1 to LM which serve as second lines are arranged in a matrix of M lines and N rows on one of substrates, and thin film transistors (abbreviated as "TFT") T(j, i) (j=1 to M, i=1 to N) which serve as pixel switching elements are arranged at intersections of the lines O1 to ON and L1 to LM.

When gate signals G1 to GM are sequentially supplied to the gate lines L1 to LM, the thin film transistors T whose gate electrodes are connected to the gate lines Lj which receive the gate signals Gj. This allows gradation display drive voltages from the source lines O1 to ON to be supplied to pixel electrodes P (j, i) through the thin film transistors T which are conducted.

Only one common electrode Q is formed on the other one of the substrates, facing the one of the substrates through a liquid crystal layer interposed therebetween, so that the common electrode Q faces all of these pixel electrodes P. Gradation display is realized by means of an electric field which is created between the common electrode Q and the pixel electrodes P which are selectively provided with the drive voltages. A voltage having a different polarity from those of the drive voltages is supplied to the common electrode Q, based on a predetermined voltage level which serves as a reference. FIG. 1 shows the common electrode Q as divided, to make it clear that displaying at one pixel is achieved by the pixel electrodes P and the common electrode Q.

The source lines O1 to ON are connected to connection terminals S1 to SN, respectively, of a source driver 37 which is realized by a semiconductor integrated circuit. The gate lines L1 to LM are connected to connection terminals G1 to GM, respectively, of a gate driver 38 which is realized by a semiconductor integrated circuit. In the following, the connection terminals and signals which are supplied to the connection terminals may be denoted by the same reference symbols in some cases.

During each horizontal scanning period WH in which the gate lines L1 to LM sequentially change to a high level, the thin film transistors T are conducted. These thin film transistors are pixel switching elements whose gate electrodes are connected to the gate lines L1 to LM. Hence, the drive voltages which correspond to gradation display data which are supplied through the source lines O1 to ON are charged at a liquid crystal layer which is disposed between the pixel electrodes P and the common electrode Q. The voltage levels which are charged in this manner are held during one vertical horizontal scanning period in which M number of lines of the gate lines L1 to LM are scanned.

To the source driver 37, serial 3-bit gradation display data D0 to D2 are sequentially supplied from a display control circuit 39. The display control circuit 39 also generates a clock signal CK and a latch signal LS, and supplies the same to the source driver 37. These reference symbols D0 to D2, CK and LS may denote signals, connection terminals or lines, as herein used. This is true with other reference symbols which are used in the following.

The clock signal CK and a signal which is in synchronization to the latch signal LS are also supplied from the display control circuit 39 to the gate driver 38 through a line 40. As described earlier, the gate driver 38 supplies the sequential gate signals G1 to GM to the gate lines L1 to LM, in synchronization.

A reference voltage source 41 is disposed to supply drive voltages to the source lines O1 to ON. The reference voltage source 41 outputs a first reference voltage whose level increases stepwise with time as that shown in FIG. 8 which will be described later. The period of the voltage which is outputted from the reference voltage source 41 is selected to be equal to one horizontal scanning period WH.

Figure 2:
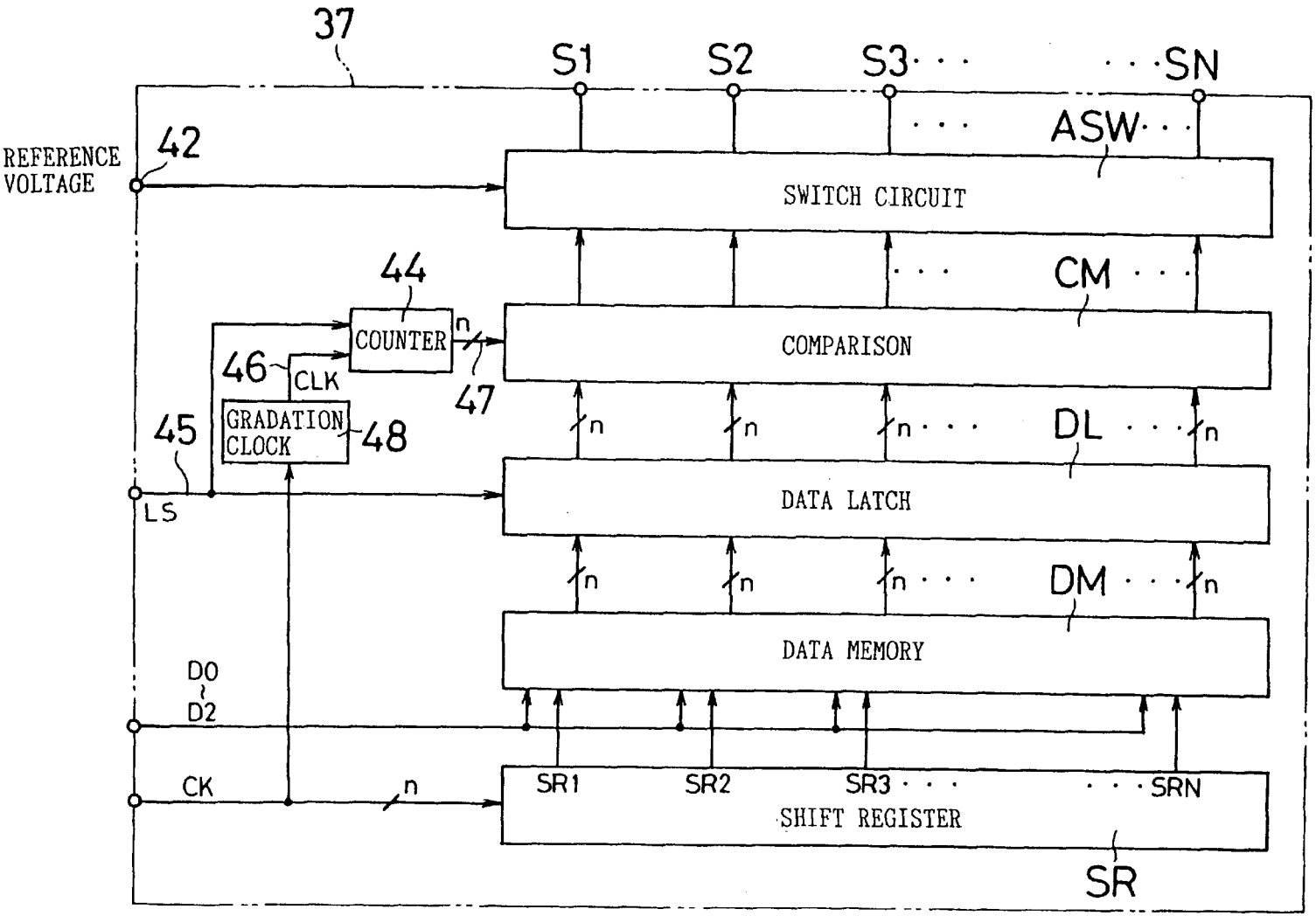
FIG. 2 is a block diagram showing a specific structure of a source driver 37 of the first embodiment of the invention.
Figure 3:
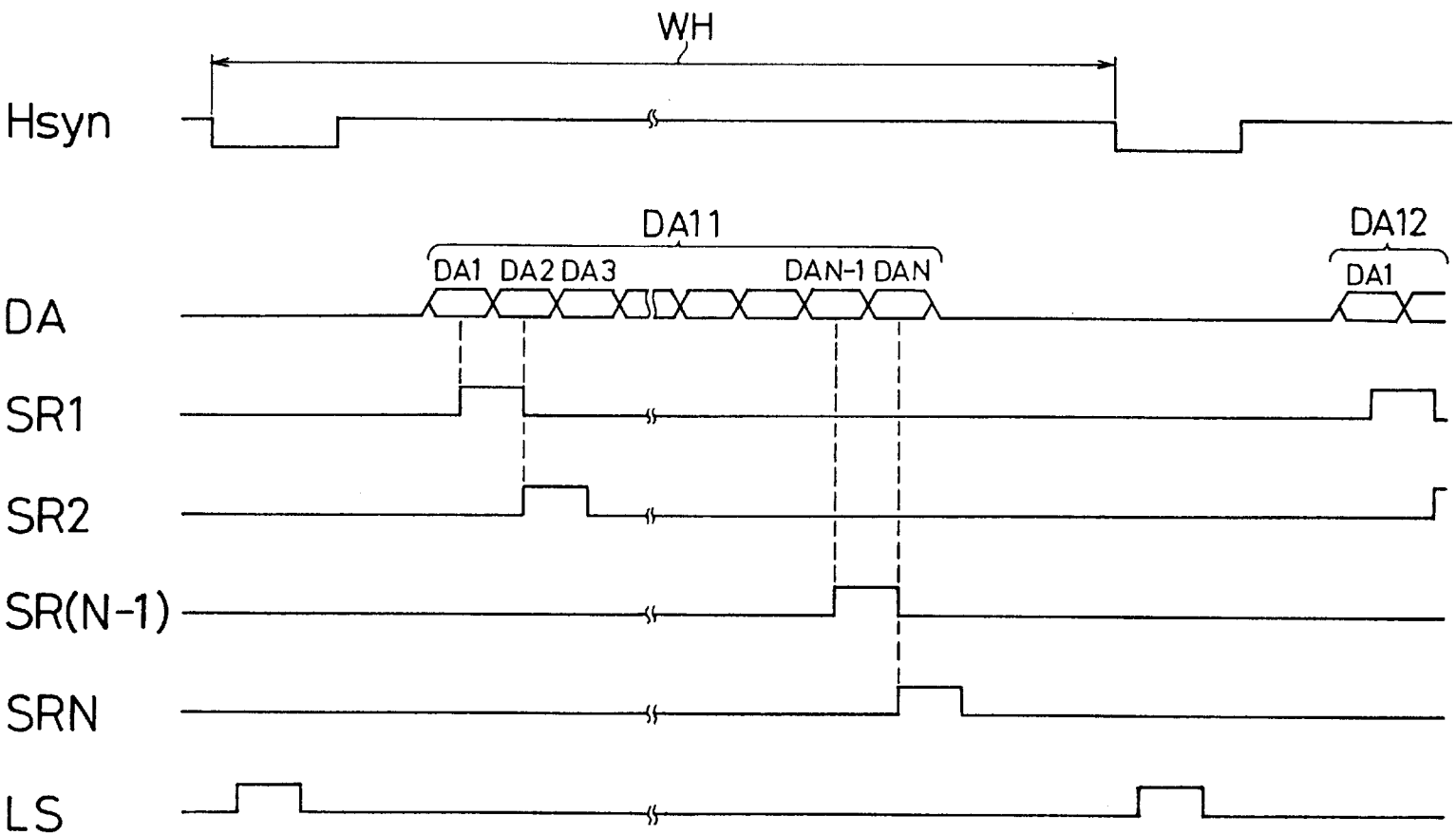
FIG. 3 is a waveform diagram for describing an operation of the source driver 37 during one horizontal scanning period WH.

FIG. 2 is a block diagram showing a specific structure of the source driver 37, and FIG. 3 is a waveform diagram for describing an operation of the source driver 37 during one horizontal scanning period WH. In FIG. 2, a reference symbol n denotes the number of lines. When gradation display data consist of the data D0 to D2 of three bits, for example, the number n may be equal to 3.

The clock signal CK is supplied successively to a shift register SR. Based on the clock signal CK, the shift register SR, which are shown in FIG. 3, sequentially outputs memory control signals SR1, SR2, . . . , SR(N−1) respectively for the source lines O1 to ON. The gradation display data D0, D1 and D2 of serial three bits from a display control circuit 39 are supplied sequentially to the respective source lines O1 to ON of the source driver 37, as denoted at DA1, DA2, DA3, . . . , DAN in FIG. 3. The gradation display data D0 to D2 which are supplied to the source driver 37 are sequentially stored in a data memory DM, in response to the memory control signals SR1 to SRN.

In response to the latch signal LS which is outputted every horizontal scanning period WH which is shown in FIG. 3, a data latch circuit DL stores and latches each one of the gradation display data of parallel three bits stored in the data memory DM, respectively in all source lines O1 to ON. An output from the data latch circuit DL is supplied to a comparison circuit CM. An output from a counter 44 is supplied to the comparison circuit CM. The counter 44 is reset by the latch signal LS which is received on a line 45, and counts a gradation clock signal CLK which is outputted from a gradation clock signal generating circuit 48 on line 46.

The comparison circuit CM compares an output from the data latch circuit DL with an output from the counter 44 on line 47, and outputs a signal to a switch circuit ASW when the two outputs coincide with each other. A reference voltage is supplied to the switch circuit ASW, and is applied to the source lines O1 to ON through the connection terminals S1 to SN. An output from the comparison circuit CM controls conduction/interruption of the reference voltage, which in turn determines a voltage to be applied to the pixel electrodes P.

The operation as described above is performed during one horizontal scanning period WH which is determined by a horizontal synchronizing signal Hsyn as that shown in FIG. 3 which is generated by the display control circuit 39.

Figure 4:
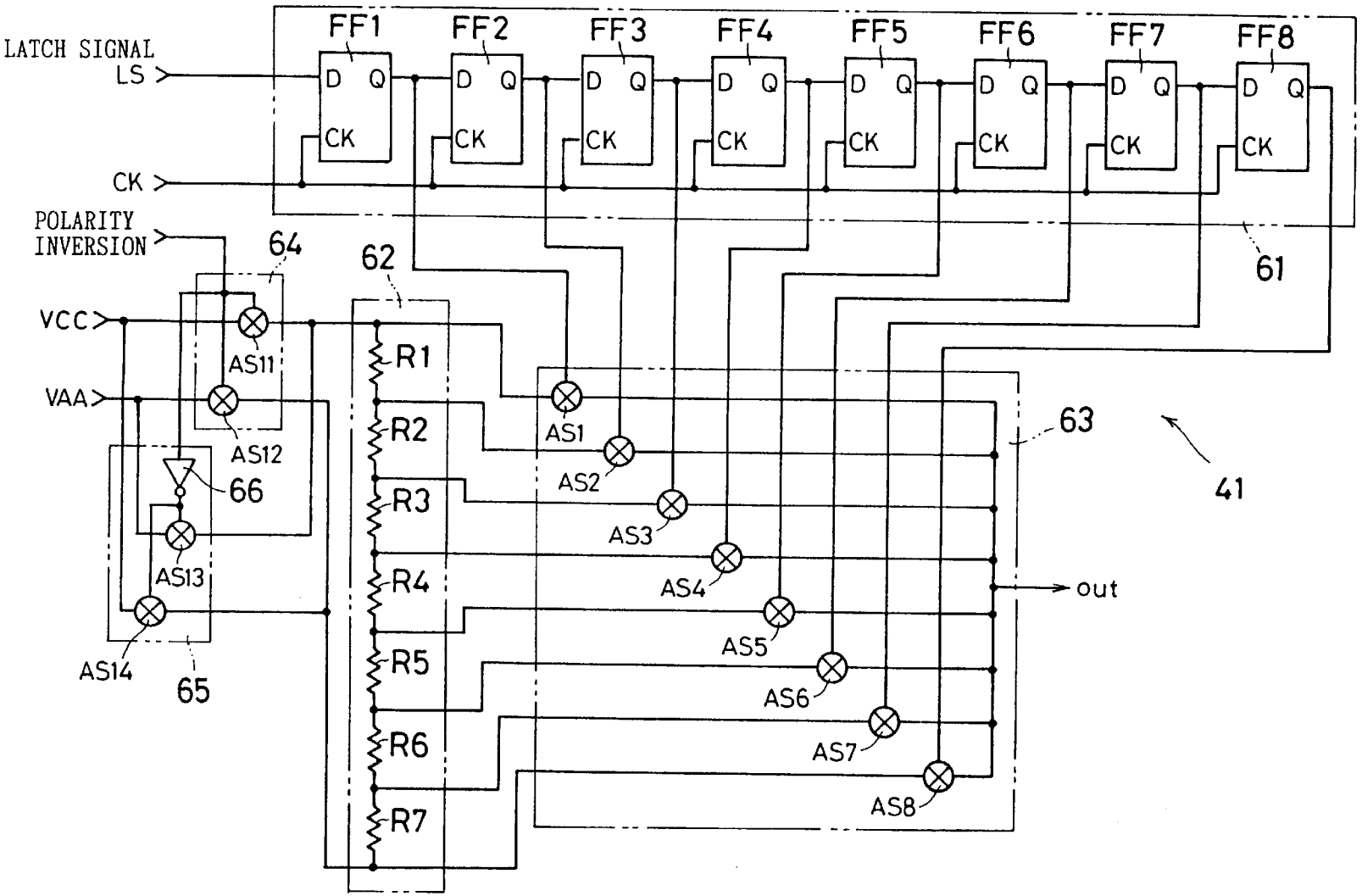
FIG. 4 is a block diagram showing a structure of a reference voltage source 41.

FIG. 4 is a block diagram showing a structure of the reference voltage source 41. In this embodiment, the reference voltage source 41 divides a voltage which is equal to or larger than a ground voltage into eight levels ranging from a voltage VAA to a voltage VCC and outputs the voltage, for instance. In the embodiment, only a constitution for generating a first reference voltage described below will be described.

The reference voltage source 41 is structured to include a timing control circuit 61, a voltage generating circuit 62, a voltage selecting circuit 63, a first inverter circuit 64 and a second inverter circuit 65. The timing control circuit 61 is formed to include a flip-flops FF1 to FF8. The flip-flops FF1 to FF8 commonly receive the clock signal CK. The latch signal LS which is supplied to the flip-flop FF1 to serve as a start pulse is supplied sequentially to the subsequent flip-flop FF, for example, every time the clock signal CK rises. Outputs from the respective flip-flops FF are supplied to eight analog switches AS1 to AS8 of the voltage selecting circuit 63, to open or close the analog switches under control. Outputs from the analog switches AS1 to AS7 of the voltage selecting circuit 63 are commonly connected.

The voltage VCC and the voltage VAA are supplied to the first inverter circuit 64 and the second inverter circuit 65, respectively, within the reference voltage source 41. The first inverter circuit 64 is formed by analog switches AS11 and AS12. An output from analog switch AS11 which receives the voltage VCC is supplied to one terminal of the voltage generating circuit 62, while an output from analog switch AS12 which receives the voltage VAA is supplied to the other terminal of the voltage generating circuit 62. The analog switches AS11 and AS12 each receive a polarity inverting signal so as to be opened or closed by the polarity inverting signal.

The second inverter circuit 65 is formed by analog switches AS13 and AS14 and an inverter 66. An output from the analog switch AS13 which receives the voltage VAA is supplied to one terminal of the voltage generating circuit 62, while an output from the analog switch AS14 which receives the voltage VCC is supplied to the other terminal of the voltage generating circuit 62. The analog switches AS13 and AS14 each receive a signal which is obtained by inverting the polarity inverting signal by the inverter 66. An output from the inverter 66 controls opening and closing of the analog switches AS13 and AS14. Hence, either one of the first inverter circuit 64 and the second inverter circuit 65 is conducted, whereby the polarity inverting signal is switched between the high level and the low level so that the voltages VCC and VAA are alternately supplied to the both terminals of the voltage generating circuit 62.

The voltage generating circuit 62 is composed of resistors R1 to R7 which are connected in series with each other between the voltages VCC and VAA. The resistors R1 to R7 each have a predetermined resistance value. Since the resistors R1 to R7 have the predetermined resistance values, it is possible to obtain a voltage waveform which corresponds to a gamma correction curve which will be described later.

A voltage at one end of the resistor R1 is supplied to the analog switch AS1 of the voltage selecting circuit 63, while a voltage at the other end of the resistor R7 is supplied to the analog switch AS8. Potentials between the resistors R1 to R7 are supplied to the analog switches AS2 to AS7.

Hence, the voltages between the two voltages which are supplied to the voltage generating circuit 62 are divided into eight levels by the resistors R1 to R7, and the eight voltages are sequentially outputted at the timing of opening or closing of the analog switches AS1 to AS8 which respectively receive the eight voltages.

Figure 5A:
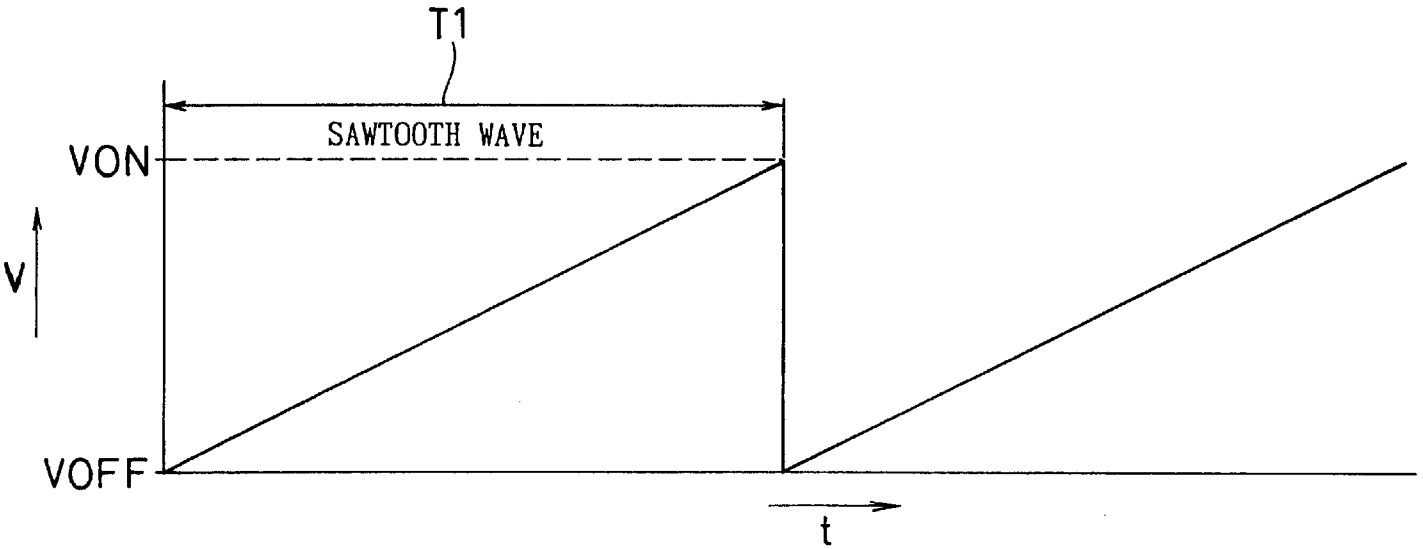
FIG. 5A is a waveform diagram for describing a characteristic of the video voltage VID which is used in the fourth prior art apparatus.

FIG. 5A is a waveform diagram for describing a characteristic of the video voltage VID which is used in the fourth prior art display apparatus. The video voltage VID linearly increases from an OFF-level voltage VOFF to an ON-level voltage VON of liquid crystal, during a period T1. Outputting during the period T1 is repeatedly performed.

Figure 5B:
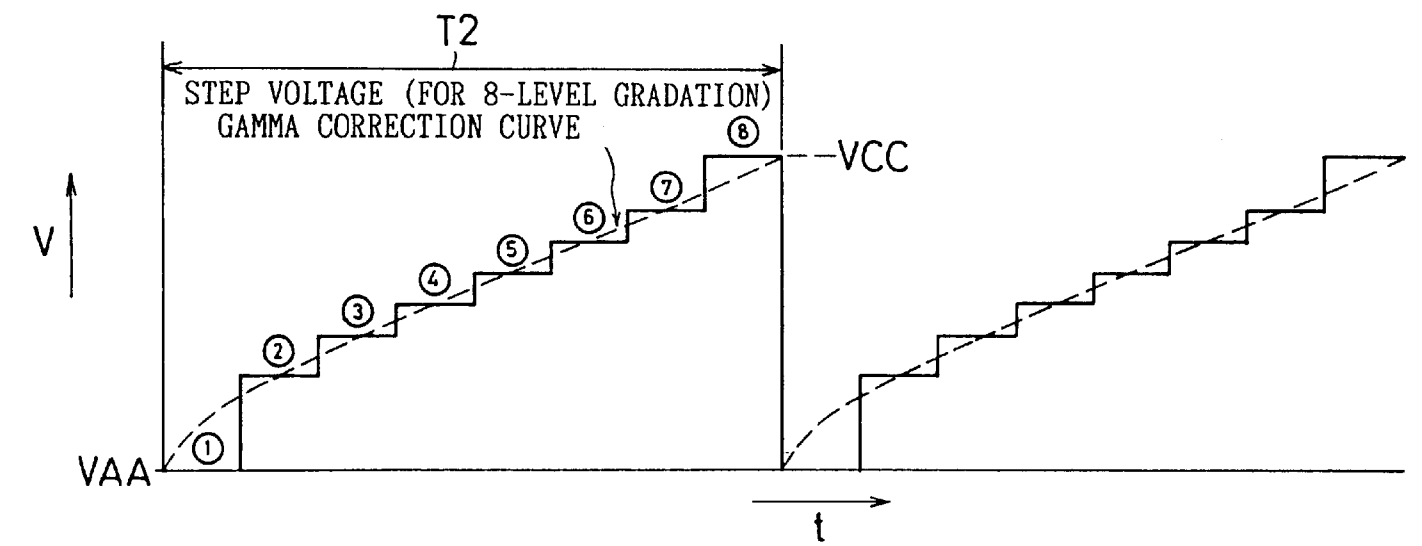
FIG. 5B is a waveform diagram of a voltage VR1 outputted by the reference voltage source 41.

FIG. 5B is a waveform diagram of the voltage VR1 which is outputted from the reference voltage source 41. The voltage VR1 is outputted stepwise as eight voltage levels from the voltage VAA to the voltage VCC, every predetermined period which is defined by equally dividing a period T2. The predetermined period is determined based on the gradation clock CLK which will be described later. The six voltage levels between the voltage VAA and the voltage VCC are determined by the resistance values of the resistors R1 to R7. Since the voltage levels can be set for each voltage, it is possible to output a voltage waveform which approximates the gamma correction curve which is denoted at the dotted line in FIG. 5B.

Figure 6:
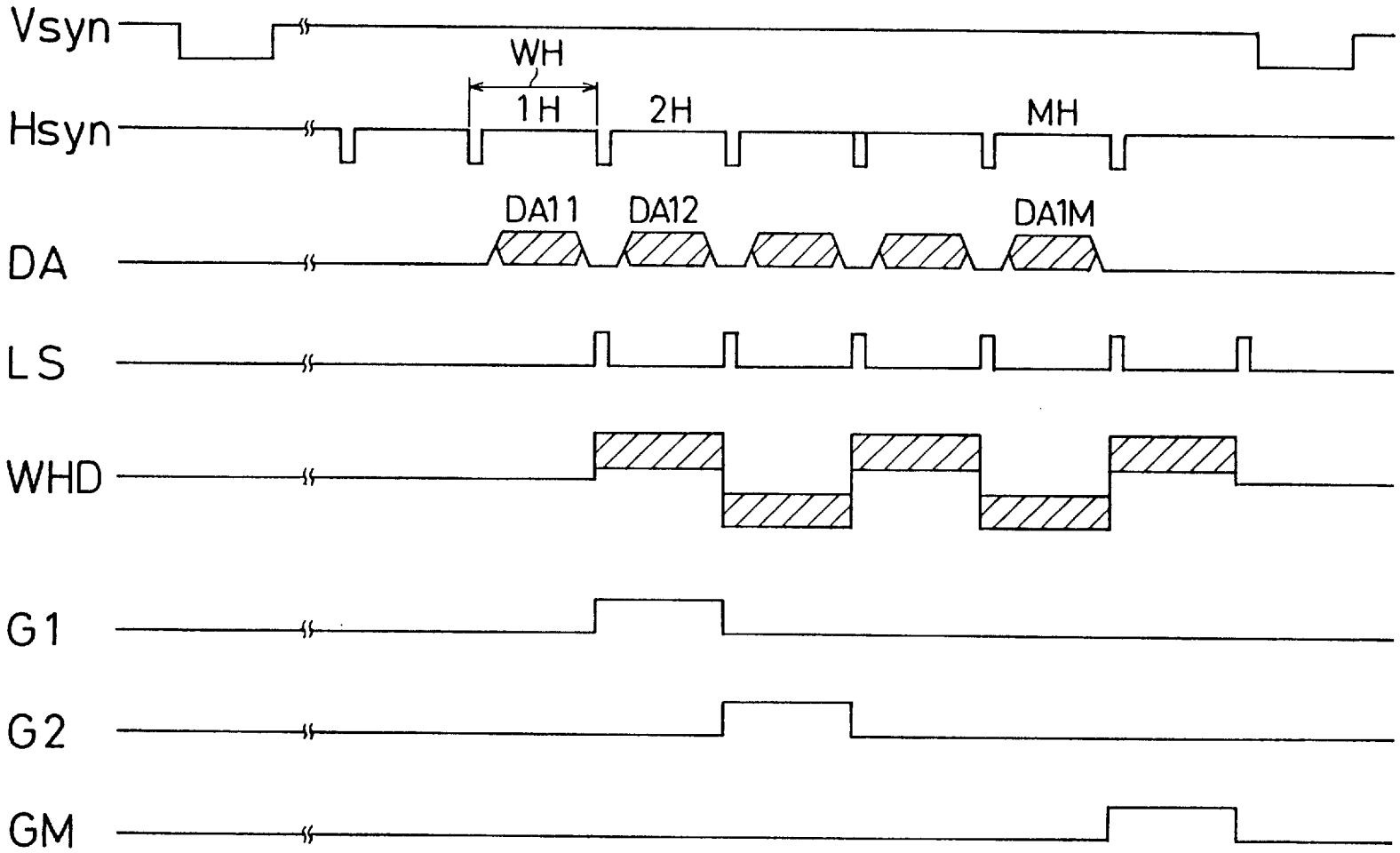
FIG. 6 is a waveform diagram for describing a timing operation realized by a display control circuit 39.

FIG. 6 is a waveform diagram for describing a timing operation realized by the display control circuit 39. The horizontal synchronizing signal Hsyn shown in FIG. 6 is generated in each one of the gate lines L1 to LM, for every cycle of a horizontal scanning signal Vsyn as that shown in FIG. 6. In FIG. 6, the reference symbols 1H, 2H, . . . , MH each denote the horizontal scanning period WH. During each horizontal scanning period WH, the display control circuit 39 generates the gradation display data DA1 to DAN which are collectively denoted as DA11, DA12, . . . , DA1M corresponding to the source lines O1 to ON, and supplies the same to the source driver 37. The collectively denoted gradation display data DA11, DA12, . . . , DA1M are shadowed with slanted lines, in order to collectively show the gradation display data DA which are supplied to the total M source lines O1 to ON. As shown in FIG. 6, the latch signal LS is generated every horizontal scanning period WH.

A signal WHD shown in FIG. 6 generally express the voltage levels which are supplied to the source lines O1 to ON in accordance with the digital gradation display data D0 to D2 which are supplied during one horizontal scanning period WH. The collectively shown signal WHD is shadowed with slanted lines, in order to generally show the voltage levels which are supplied to the total M source lines O1 to ON. In the non-interlace method, one picture screen of the display panel 36 is displayed during one vertical scanning period. The invention can be applied to the non-interlace method, as well.

FIG. 6 shows the waveforms of the gate signals G1, G2 and GM which are supplied from the gate driver 38 to the gate lines L1, L2 and LM, respectively. For instance, when the j-th gate signal Gj is at the high level, total N thin film transistors T(j, i) (j=1 to M, i=1 to N) whose gate electrodes are connected to the gate line Lj all turn on, whereby the pixel electrodes P(j, i) are charged in accordance with the drive voltages which are supplied to the source line Oi. By repeating the operation as above for M times in total in correspondence with the gate lines L1 to LM, one picture screen during one vertical scanning period for the non-interlace method is displayed. The polarity of the voltage which is supplied to each pixel electrode is inverted for every vertical scanning period, i.e., for every field, by the so-called a.c. driving method, so that deterioration of the liquid crystal is suppressed.

Figure 7:
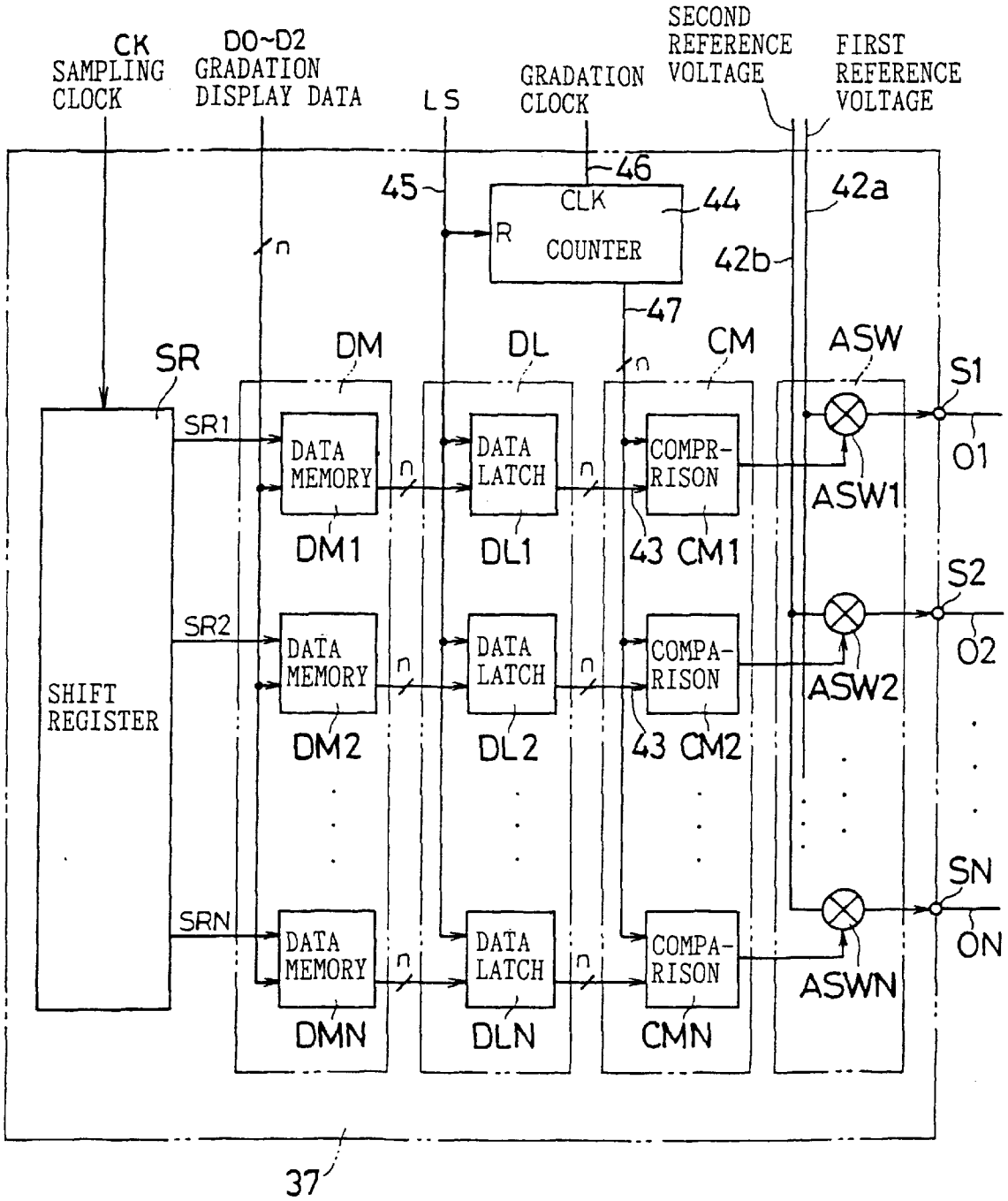
FIG. 7 is a block diagram showing a specific structure of each source line Oi of the source driver 37.

FIG. 7 is a block diagram showing a specific structure of each source line Oi of the source driver 37. A data memory DMi which corresponds to an i-th (i=1 to N) source line Oi samples and stores the gradation display data consisting of the serial 3-bit D0 to D2, when a memory control signal SRi is received from the shift register SR. A data latch circuit DLi which corresponds to the source line Oi of the data latch circuit DL stores and latches the parallel 3-bit gradation display data which are stored in the data memory DMi, when the latch signal LS is received. The gradation display data signal of parallel three bits is supplied to one input of a comparison circuit CMi which corresponds to each source line Oi of the comparison circuit CM, through a line 43.

The source driver 37 also includes the counter 44. The counter 44 is reset and initialized in response to the latch signal LS which is supplied through the line 45 so that a count is returned to zero. The counter 44 thereafter adds the gradation clock signals CLK which are supplied through a line 46 and yields a count. A 3-bit output which expresses the count is supplied to the other inputs of the comparison circuits CM1 to CMN which are disposed in common to the source line Oi, through a line 47. In this embodiment, the number of the bits or the lines is n=3, for instance.

The gradation clock signals CLK which are supplied to the counter 44 are outputted as outputs from the gradation clock signal generating circuit 48 which frequency-divides the clock signal CK.

In a switch circuit ASW, analog switches ASW1 to ASWN which serve as voltage applying switching elements are independently disposed between lines 42*a* and 42*b* which receive the reference voltages from the reference voltage source 41 and the respective source lines O1 to ON. The analog switches ASW1 to ASWN form the switch circuit ASW.

When the reference symbol N which expresses the number of the source lines O is an even number, the line 42*a* which receives the first reference voltage is connected to the analog switches ASW1, ASW3, . . . , ASWN-1, whereas the line 42*b* which receives the second reference voltage is connected to the analog switches ASW2, ASW4, . . . , ASWN. The directions in which the first and the second reference voltages change are different from each other, and have opposite voltage values with respect to an opposed voltage VCOM which is supplied to opposed electrodes. The directions in which the first and the second reference voltages change are changed every frame, to thereby alternately drive the liquid crystal. Further, while the source driver 37 shown in FIG. 7 is structured so as to receive the gradation clock signals CLK from outside, the gradation clock signal generating circuit 48 may be disposed within the source driver 37 as shown in FIG. 2 to reduce the number of the signal input terminals of the source driver 37 by 1.

Figure 8:
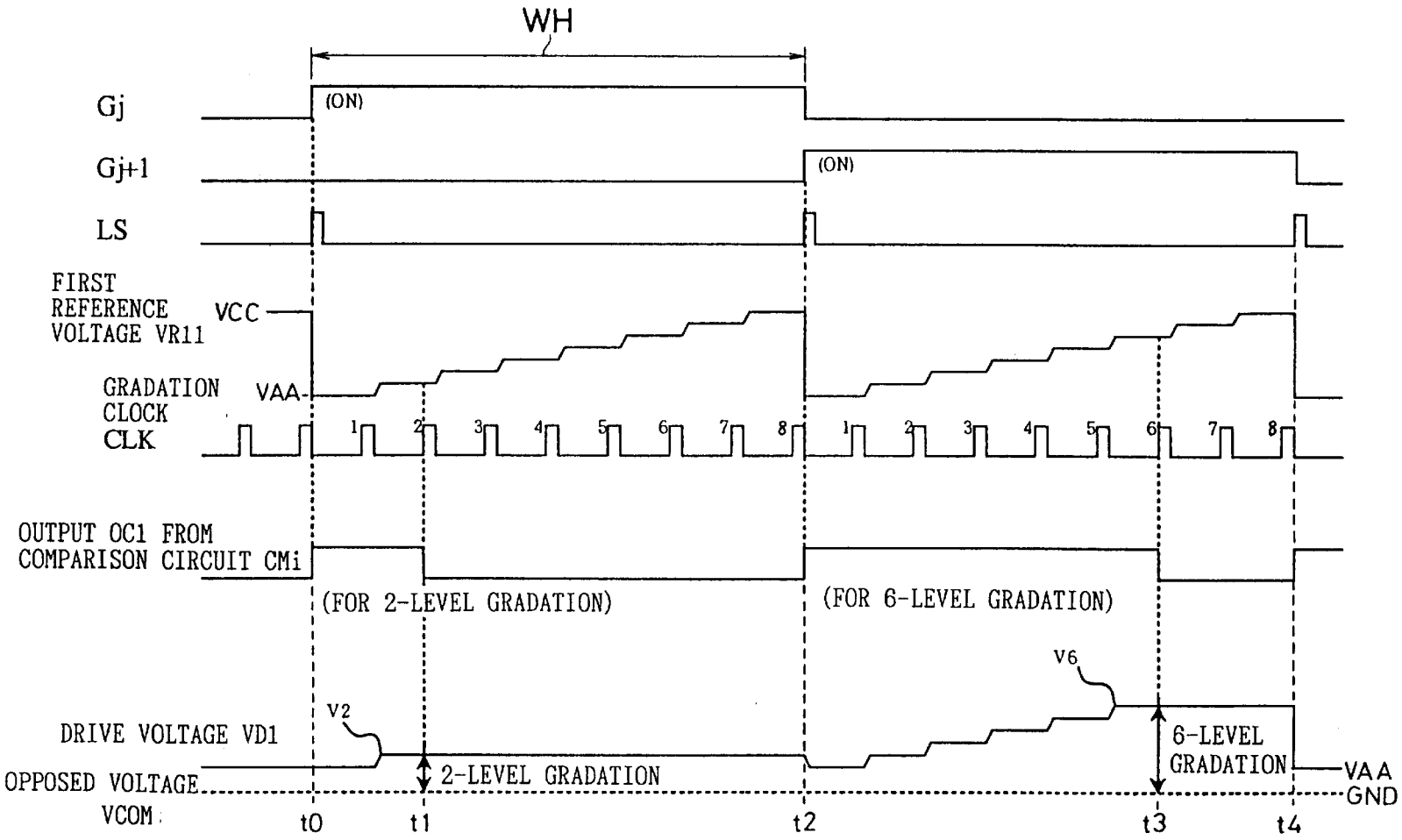
FIG. 8 is a waveform diagram for describing an operation of the source driver 37.

FIG. 8 is a waveform diagram for describing an operation of the source driver 37. When the gate signal Gj (j=1 to M) having a waveform as that shown in FIG. 8 is supplied to the gate line Lj, during the horizontal scanning period WH from a time t0 to a time t2 in which the gate signal Gj remains at the high level, the thin film transistors T whose gate electrodes are connected to the gate line Lj are conducted, whereby voltages on the source lines O1 to ON are supplied to the pixel electrodes P through those thin film transistors T. During the horizontal scanning period WH from the time t2 to a time t4, a gate signal Gj+1 as that shown in FIG. 8 is at the high level.

The latch signal LS as that shown in FIG. 8 is generated in synchronization to the aforementioned horizontal synchronizing signal Hsyn shown in FIG. 3. The latch signal LS allows the data latch circuits DL1 to DLN to latch the gradation display data while initializing and resetting the counter 44. The display control circuit 39 supplies the synchronizing signals through the line 49 (See FIG. 1), so that the reference voltage source 41 outputs the first reference voltage VR11 to the line 42*a*, which increases stepwise with time, after the time t0. Although not shown in the timing chart, the second reference voltage increases or decreases in an opposite direction to that of the first reference voltage, by a voltage difference each time which is equal to the voltage difference by which the first reference voltage changes, from the opposed voltage VCOM which is smaller than the voltage VAA. The opposed voltage VCOM is defined, for example, to be a ground voltage GND.

The gradation clock signal generating circuit 48 outputs as many gradation clock signals CLK as the gradation levels which are to be expressed by the gradation display data or more gradation clock signals CLK in a time-sequential manner during one horizontal scanning period WH, in response to the clock signal CK and hence in synchronization to the horizontal synchronizing signal Hsyn. In this embodiment, eight gradation clock signals CLK are generated during the horizontal scanning period WH, to realize 8-level gradation display using the gradation display data consisting of the serial 3-bit D0 to D2. The number of the gradation clock signals CLK to be generated during the horizontal scanning period WH may be larger than 8.

The counter 44 counts the gradation clock signals CLK and supplies a count to the other input of the comparison circuit CMi through the line 47, as described before. The count of the counter 44 is denoted by FIGS. 1, 2, 3, . . . , 8 in FIG. 8.

When the gradation display data which are latched in the latch circuit DL1 is, for example, "2", an output OC1 from the comparison circuit CMi latch circuit DLi shown in FIG. 8 is at the high level from the time t0 to the time t1. The output expressing the gradation display data of "2" is supplied to one input 43 of the comparison circuit CMi while the count of the counter 44 is supplied to the other input as described above. The output OC1 is supplied to the analog switch ASWi, as a switching control signal.

The switching control signal is at the high level when the count of the counter 44 performing addition is smaller than a value which corresponds to the gradation display data of "2" so as to keep the analog switch ASWi conducted, but changes to the low level at the time t1 when the count of the counter 44 becomes equal to or larger than the value which corresponds to the gradation display data of "2" so as to cut off the analog switch ASWi. The drive voltage VD1 is applied to the source line Oi through the connection terminal Si, in this manner. The first reference voltage VR11 is directly supplied to the source line Oi from the time t0 to the time t1.

After the time t1, since the analog switch ASWi is cut off as described above, the voltage V2 is supplied to the pixel electrodes P as the drive voltage VD1 which corresponds to the gradation display data of "2" so that a charge is accumulated at a pixel display portion of the display panel and the voltage V2 is held. Further, in FIG. 8, the opposed voltage VCOM which is supplied to the common electrode Q is denoted by the wave line. The opposed voltage VCOM is constant from the time t0 to the time t4.

When the gradation display data which is latched and outputted by the latch circuit DLi during the horizontal scanning period from the time t2 to the time t4 is "6," the comparison circuit CMi provides the analog switch ASWi with a signal which remains at the high level until the count of the counter 44 coincides with the gradation display data of "6". At the time t3 when the count coincides with the gradation display data, the analog switch ASWi is cut off. That is, the analog switch ASWi remains conducted from the time t2 to the time t3.

Since the analog switch ASWi remains conducted from the time t2 to the time t3, the drive voltage V6 is supplied to the source line Oi on the line 42, through the analog switch ASWi and the connection terminal Si. As a result, the voltage V6 which corresponds to the gradation display data of "6" is held at the pixel electrodes P through the conducted transistors T.

Such an operation is repeated for each one of the gate lines L1 to LM every horizontal scanning period WH, whereby a drive voltage whose level corresponds to gradation display data for the pixel electrodes P is held during one vertical scanning period.

Figure 9:
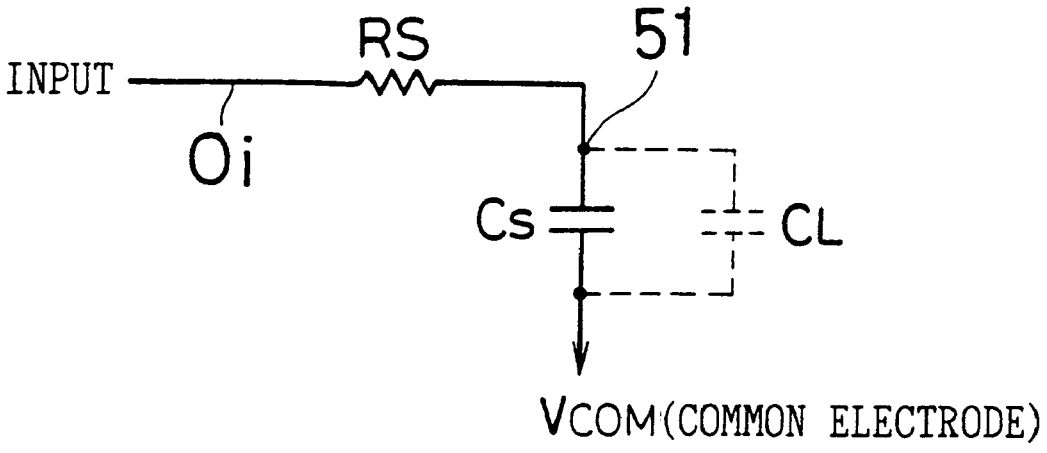
FIG. 9 is an equivalent circuitry diagram for describing principles of holding a voltage in a liquid crystal display panel 36.

FIG. 9 is an schematic equivalent circuitry diagram showing the liquid crystal display panel 36 to describe the principles of the invention. The invention considers a so-called low-pass filter circuit in which the resistor Rs of one source line Oi to be driven by the source driver 37 is connected to an electrostatic capacity Cs of the source line Oi in series.

An equivalent capacity of the pixel electrode P is denoted by the reference symbol CL. The electrostatic capacity CL of the pixel electrode P is sufficiently smaller than the capacity Cs of the source line Oi ($CL \ll Cs$). Hence, a voltage which is applied to the pixel electrode P has the same voltage level as a voltage at a connection point 51 between the resistor Rs and the electrostatic capacity Cs. Therefore, in the equivalent circuit shown in FIG. 9 which has a function of a low-pass filter, the pixel electrode P is charged by supplying the reference voltage to the source line Oi through the analog switch ASWi. For example, when a time constant $Cs \times Rs = 10^{-7}$, a conduction time of the analog switch ASWi only has to be at least 20 to 30 $\mu$ sec or longer.

In this manner, the invention positively utilizes the resistor Rs and the electrostatic capacity Cs of the source line Oi which are inherent to the display panel 36 to thereby hold voltages at the pixel electrodes P. Further, other embodiment of the invention requires to dispose an auxiliary capacity between the gate line L(j−1) which is scanned immediately before the gate line Lj to which the gate electrode of the transistor T is connected and the source line Oi on one of the substrates which seats the pixel electrodes P, so as to virtually increase the capacity for holding voltages at the pixel electrodes P.

Figure 10:
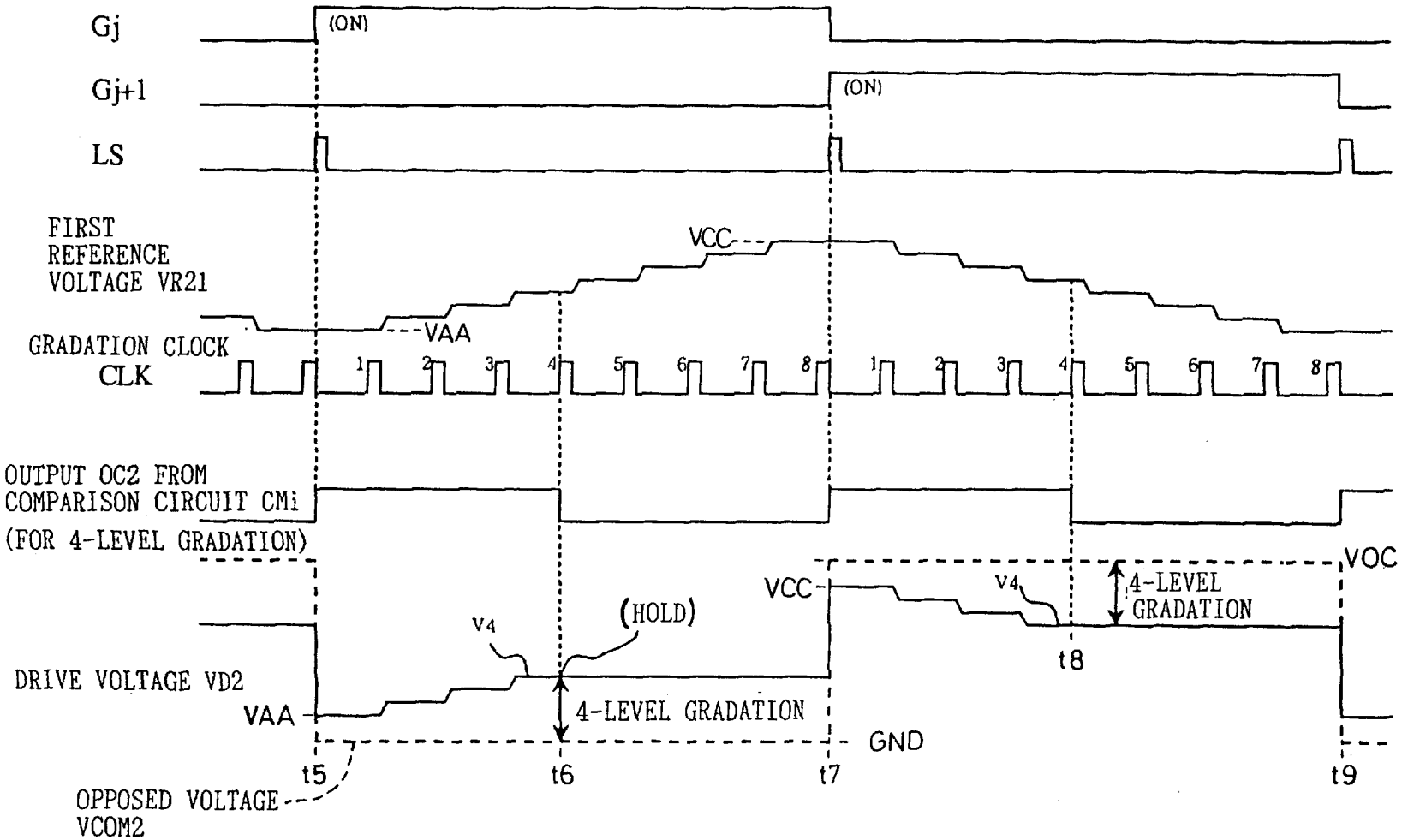
FIG. 10 is a waveform diagram for describing an operation of a source driver 137 of a second embodiment of the present invention.

FIG. 10 a diagram for describing an operation of a source driver 137 of a second embodiment of the present invention. The source driver 137 has the same structure as the aforementioned source driver 37, and therefore, a description on the structure of the source driver 137 will be omitted. Instead, a description will be given on a characteristic of the source driver 137, as compared with the source driver 37. The signals Gj, Gj+1, LS and CLK are the same as the signals Gj, Gj+1, LS and CLK which are shown in FIG. 8, and therefore, will not be described.

While the first reference voltage VR11 is outputted stepwise from the voltage VAA to the voltage VCC every horizontal scanning period in FIG. 8, a reference voltage VR21 shown in FIG. 10 is outputted as it increases from the voltage VAA to the voltage VCC every horizontal scanning period and as it decreases from the voltage VCC to the voltage VAA every horizontal scanning period. Further, a second reference voltage which is not shown has a voltage waveform which is shifted from that of the first reference voltage each by one horizontal scanning period.

When the source driver 137 drives the source lines O1 to ON, an opposed voltage VCOM2 as that shown by the dotted line in FIG. 10 is applied to the common electrode Q. The opposed voltage VCOM2 is at a ground voltage GND during the horizontal scanning period from a time t5 to a time t7, for instance, but is at a voltage VOC which is determined as equal to or larger than the voltage VCC during the horizontal scanning period from the time t7 to a time t9. Each voltage is determined as satisfying VOC−VCC=VAA−GND.

Since gradation display data which are latched and outputted by the latch circuit DLi is "4" in FIG. 10, an output OC2 from the comparison circuit CMi remains at the high level until the count of the counter 44 coincides with the gradation display data of "4." This keeps the analog switch ASWi conducted from the time 5 to the time t6. Hence, the first reference voltage VR21, for instance, which is supplied through the analog switch ASWi and the connection terminal Si on the line 42 is supplied to the source line Oi as a drive voltage VD2. As the drive voltage VD2, the voltage V4 which corresponds to the gradation display data of "4" is applied to the pixel electrodes P, through the conducting transistors T. Such an operation is repeated for each one of the gate lines L1 to LM every horizontal scanning period WH, whereby drive voltages which correspond to gradation display data are applied to the pixel electrodes P and held during one vertical scanning period.

Figure 11:
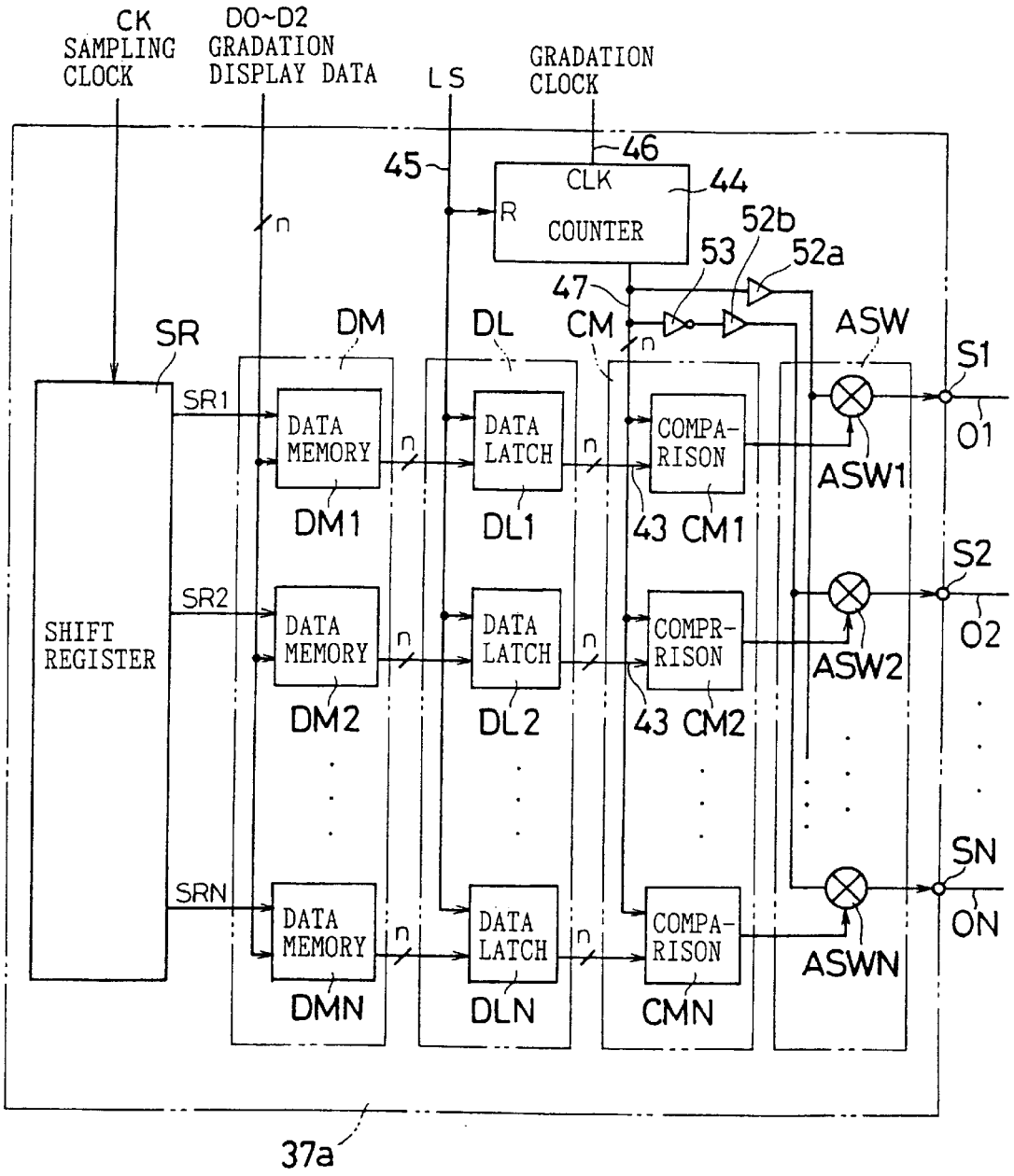
FIG. 11 is a block diagram showing a specific structure of a source driver 37*a* of a third embodiment of the invention.

FIG. 11 is a block diagram showing a specific structure of a source driver 37*a* of a third embodiment of the present invention. Since this embodiment is similar to the embodiments heretofore described, the same reference symbols are assigned to corresponding portions, and a redundant description will be omitted. While the reference voltage source 41 is disposed externally to the source driver 37 in the embodiments which are shown in FIGS. 1 to 10, this embodiment requires that the source driver 37*a* incorporates digital-to-analog convertors 52*a* and 52*b* (hereinafter referred to as "DAC") having the same structure and an inverter 53 and that the source driver 37*a* is realized by only one semiconductor integrated circuit and the other remaining circuit elements.

Figure 13:
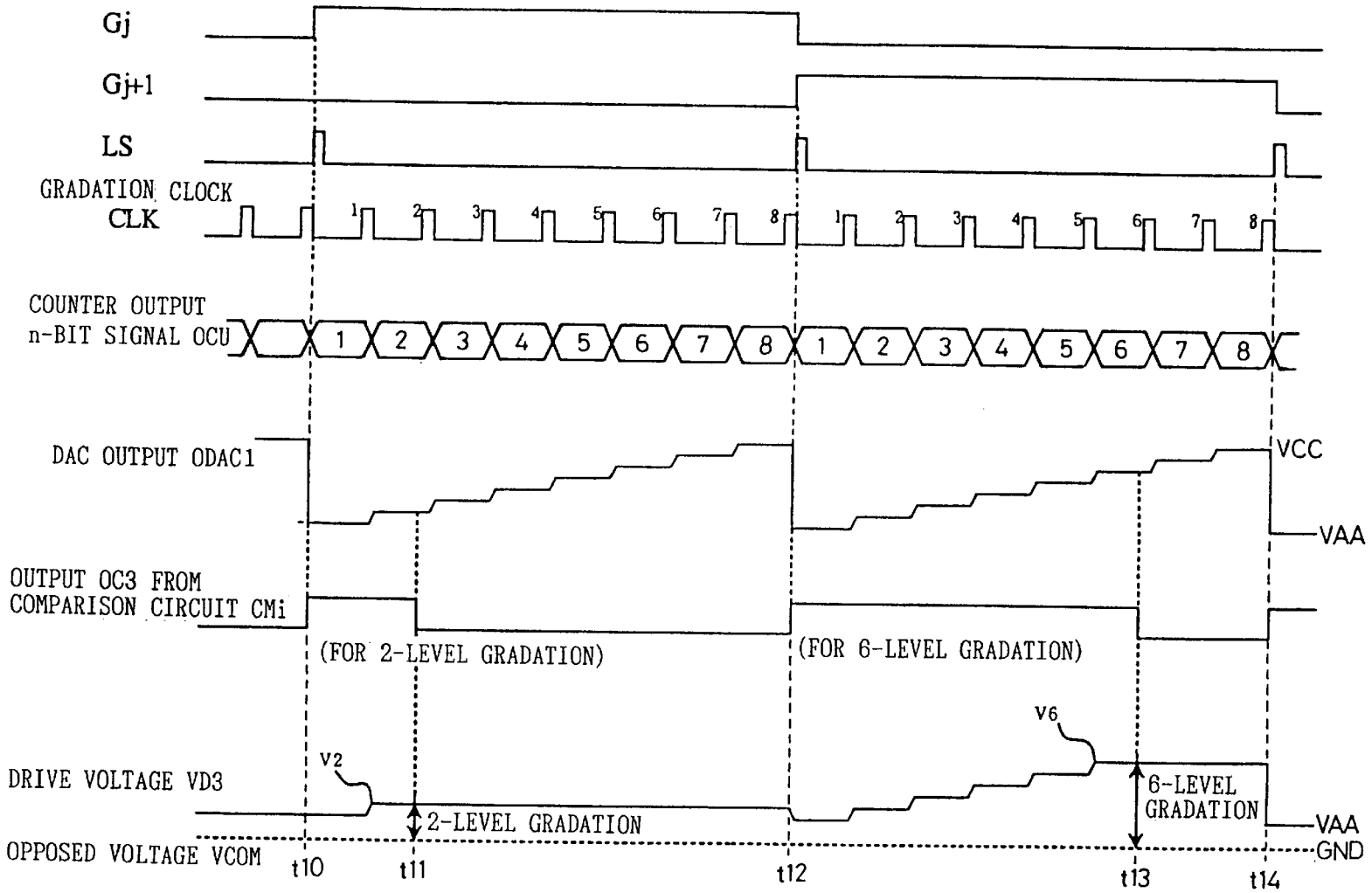
FIG. 13 is a waveform diagram for describing an operation of the source driver 37*a;*

The DACs 52*a* and 52*b* receive signals expressing counts which are outputted onto the line 47 from the counter 44, and output voltages which have voltage values which correspond to the counts. An output from the DAC 52*a* is supplied to the analog switch ASWi, just like the first reference voltage described above. An output from the DAC 52*b* is supplied to the analog switch ASWi, just like the second reference voltage described above. The other structure is similar to those of the embodiments heretofore described. FIG. 13 which will be described later shows an output ODAC1 from the DAC 52*a*.

Figure 12:
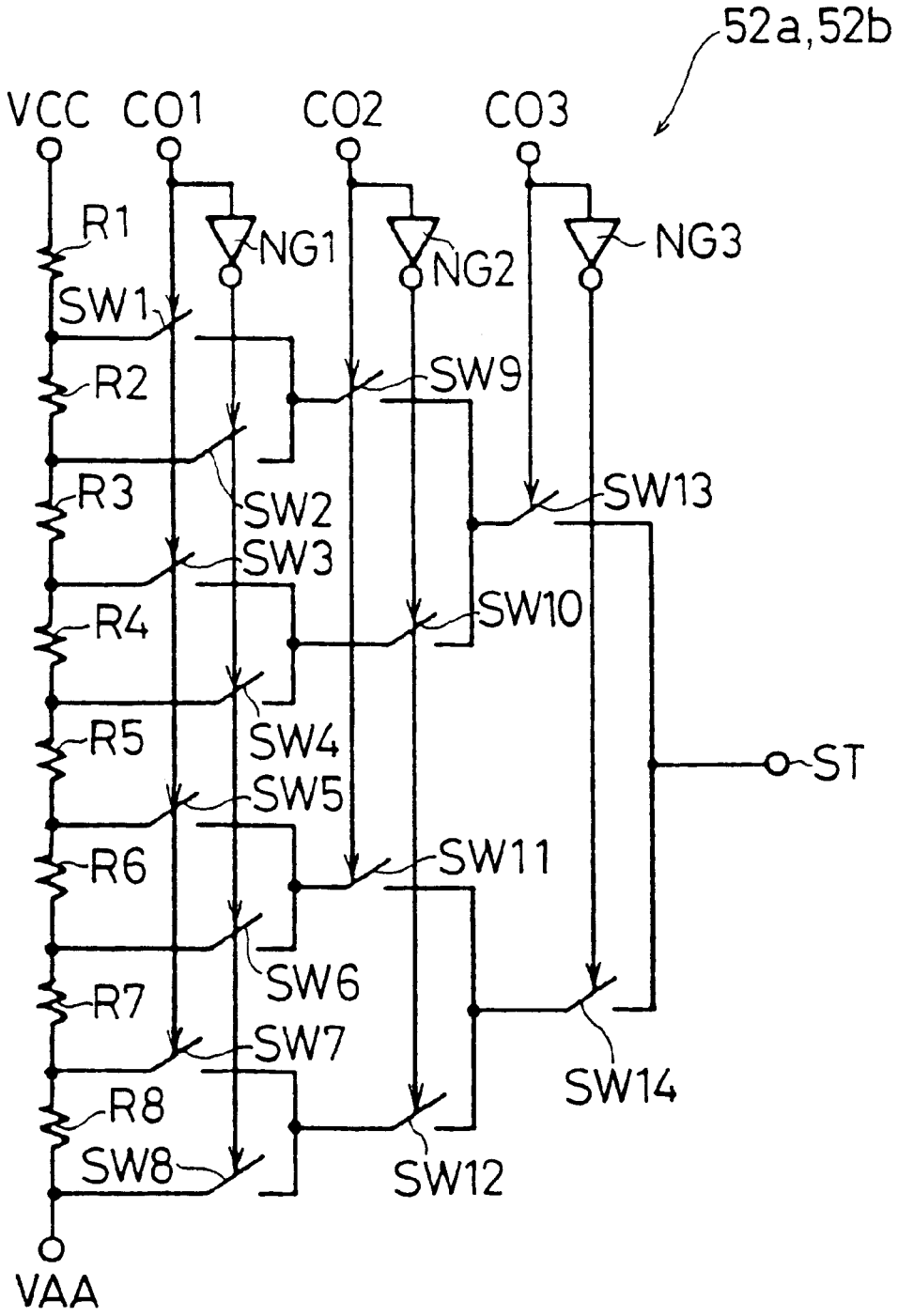
FIG. 12 is a circuitry diagram of digital-to-analog convertors 52*a* and 52*b;*

FIG. 12 is a circuitry diagram of the DACs 52*a* and 52*b*. In the following, the DAC 52*a* will be explained as a representative. The DAC 52*a* is composed to include the resistors R1 to R8, inverters NG1 to NG3 and switches SW1 to SW14.

The resistors R are connected with each other in series from the resistor R1, in such a manner that a terminal of the resistor R1 side is connected to the voltage VCC and a terminal of the resistor R8 side is connected to the voltage VAA. The switches SW1 to SW8 are sequentially disposed between the respective resistors R and between the resistor R8 and the ground voltage. As counted in an order from the switch SW1, two switches SW are regarded as pair, and outputs from these switches SW are supplied to the switches SW9 to SW12. Further, outputs from the switches SW9 and SW10 are supplied to the switch SW13, and outputs from the switches SW11 and SW12 are supplied to the switch SW14. Outputs from the switches SW13 and SW14 are commonly connected to an output terminal ST.

An output from the counter 44 is regarded from the least significant bit as signals CO1, CO2 and CO3. The signal CO1 conducts the switches SW1, SW3, SW5 and SW7 while a signal which is obtained by inverting the signal CO1 by the inverter NG1 conducts the switches SW2, SW4, SW6 and SW8. The signal CO2 conducts the switches SW9 and SW11 while a signal which is obtained by inverting the signal CO2 by the inverter NG2 conducts the switches SW10 and SW12. Further, the signal CO3 conducts the switch SW13 while a signal which is obtained by inverting the signal CO3 by the inverter NG3 conducts the switch SW14. An output from either one of the switches SW13 and SW14 is supplied to the output terminal ST.

FIG. 13 is a waveform diagram for describing an operation of the source driver 37*a*. The gate signal Gj as that shown in FIG. 13 is outputted to the gate line Lj and the thin film transistors T whose gate electrodes are connected to the gate line Lj are conducted, so that the latch signal LS is generated every horizontal scanning period. FIG. 13 also shows the gate signal Gj+1 which is applied to the gate line Lj+1. The gradation clock signals CLK are supplied to the counter 44 through the line 46. The signals Gj, Gj+1, LS and CLK in FIG. 13 are the same as the signals Gj, Gj+1, LS and CLK which are shown in FIG. 8.

The counter 44 outputs a signal OCU which consists of n bits to express a count to the line 47, and supplies the same commonly to the comparison circuits CM2 to CMN and also to the DAC 52*a* in this embodiment.

In response to the signal which expresses a count through the line 47, the DAC 52*a* outputs an output ODAC1 which increases stepwise with time. Hence, when gradation display data is "2" as described above, for instance, the DAC 52 outputs a signal which stays at the high level only from a time t10 to a time t11 as that described as the output OC3 from the comparison circuit CMi, to thereby conduct the analog switch ASWi. Since the analog switch ASWi is conducted, a drive voltage VD3 becomes the voltage V2 on the source line Oi so as to correspond to the gradation display data of "2." The drive voltage VD3 is held until a time t12 at which the horizontal scanning period ends.

When gradation display data is "6" during the horizontal scanning period from the time t12 to a time t14, the output OC3 from the comparison circuit CMi is at the high level from the time t12 until the time t13 at which a count of the counter 44 coincides with the gradation display data of "6." Hence, the voltage V6 is outputted to the source line Oi, as the drive voltage VD3 which corresponds to the gradation display data of "6" through the analog switch ASWi. Drive voltages which are applied to the pixel electrodes P at the time t13 are held until the time t14.

As described above, of the third embodiment of the present invention, the counter 44 and the digital-to-analog convertor 52 are incorporated within the source driver 37*a* which is realized by a semiconductor integrated circuit in order to generate the reference voltages which are used for gradation display. Hence, it is not necessary to supply the reference voltages from the external reference voltage source 41 (See FIG. 1), and therefore, it is possible to reduce the number of the connection terminals which supply the reference voltages and to simplify the structure. The other structure is similar to those of the embodiments heretofore described.

Figure 14:
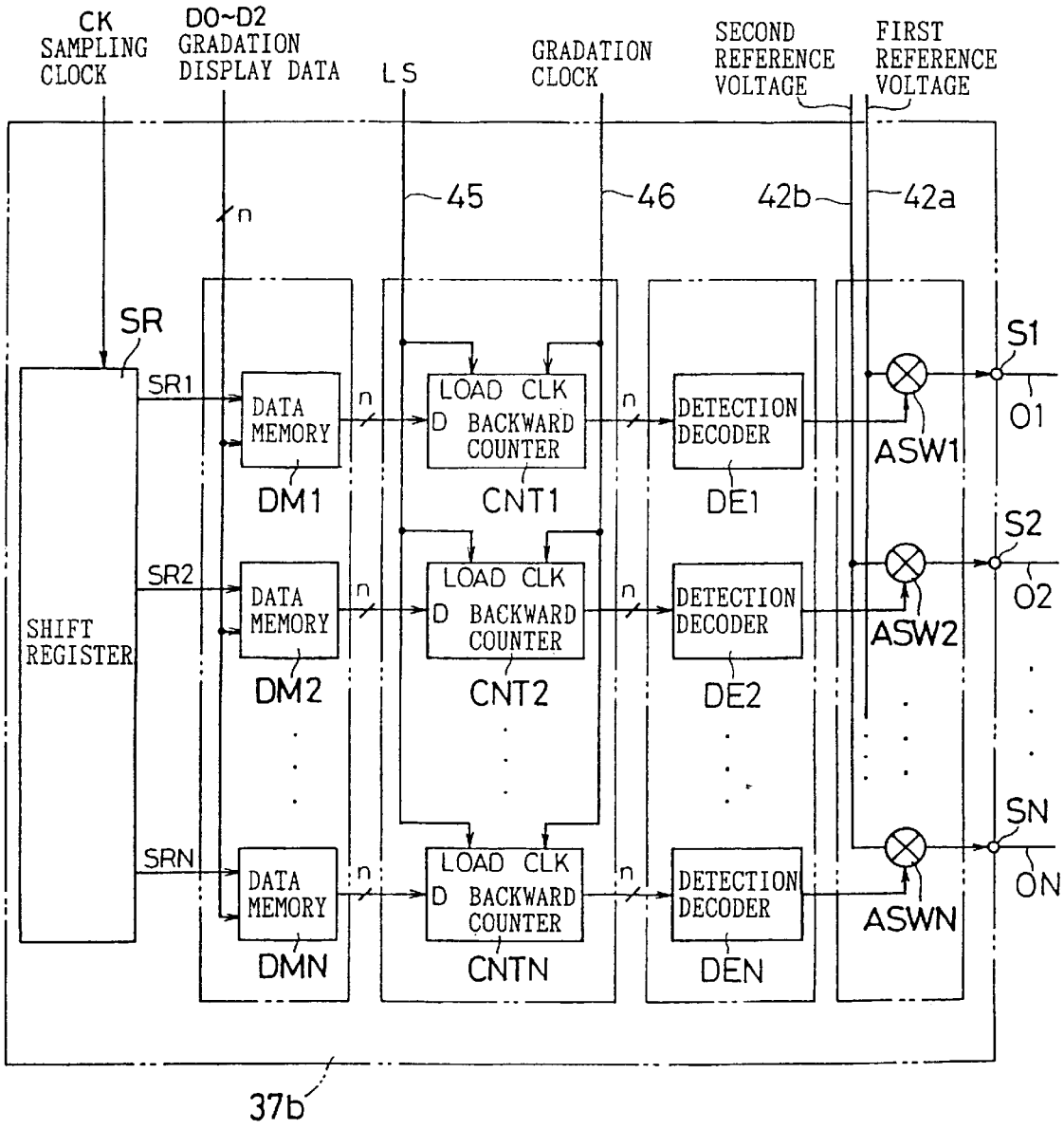
FIG. 14 is a block diagram showing a specific structure of a source driver 37*b* of a fourth embodiment of the invention.

FIG. 14 is a block diagram showing a specific structure of a source driver 37*b* of a fourth embodiment of the present invention. This embodiment as well is similar to the embodiments heretofore described, and therefore, the same reference symbols are assigned to corresponding portions and a redundant description will be omitted.

This embodiment replaces the latch circuit DLi of the embodiments heretofore described with a backward counter CNTi, and uses a detection decoder DEi which detects that a count of the backward counter CNTi reaches a predetermined, e.g., zero. The other structure is similar to those of the embodiments heretofore described. The first and the second reference voltages which increase or decrease stepwise with time are supplied to the respective analog switches ASWi on the line 42, and thereafter, to the respective source lines Oi through the connection terminals Si.

Figure 15:
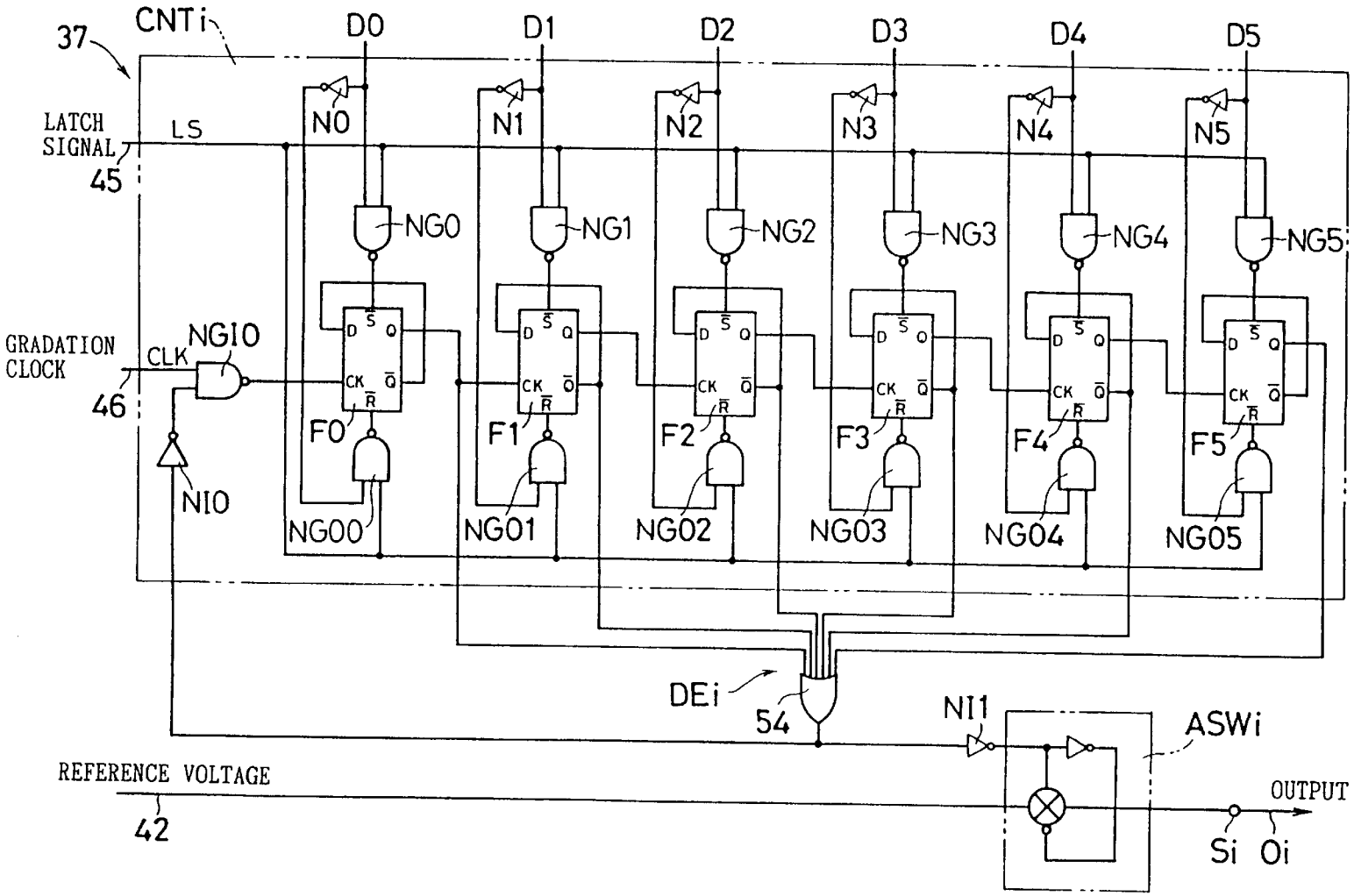
FIG. 15 is a block diagram showing a specific structure of a backward counter CNTi and a detection decoder DEi of the embodiment of FIG. 14.

FIG. 15 is a block diagram showing a specific structure of the backward counter CNTi and the detection decoder DEi. FIG. 15 shows an example where gradation display data are consisting of six bits, the gradation display data may be consisting of an optional number of bits.

Parallel 6-bit gradation display data D0 to D5 from the data memory circuit DMi are supplied to set input terminals S* (The symbol * denotes inversion.) of D-type flip-flops F0 to F5 each having RS (reset, set), through NAND gates NG0 to NG5 which receive the latch signal at one input terminals thereof. The gradation display data D0 to D5 which are supplied to inversion circuits N0 to N5 are also supplied to reset input terminals R* through NAND gates NG00 to NG05 which receive the latch signal at one input terminals thereof.

The flip-flops F0 to F5 are connected to each other in series or in cascade. The latch signal LS is supplied to the other inputs of the NAND gates NG0 to NG5 and NG00 to NG05 on the line 45. Outputs Q* from the flip-flops F0 to F5 are supplied to data input terminals D.

An output from the NAND gate NGI0 is supplied to a clock input terminal CK of the first-stage flip-flop F0. The gradation clock signal CLK is supplied to one input of the NAND gate NGI0 through the line 46, while an output from an NOR gate 54, which will be described later, as it is inverted is supplied to the other input of the NAND gate NGI0. Outputs Q from the respectively precedent flip-flops F0 to F4 are supplied to the clock input terminals CK of the flip-flops F0 to F5.

Now, an operation of the backward counter CNTi will be described. When the latch signal LS is supplied to the backward counter CNTi, the respective bits of the gradation display data D0 to D5 are loaded to the flip-flops F0 to F5. The gradation display data loaded to the flip-flops F0 to F5 are successively decreased in response to the gradation clock signal. When the outputs Q of all flip-flops F0 to F5 which form the backward counter CNTi become logic "0" the detection decoder DEi detects this.

The detection decoder DEi includes the NOR gate 54 and an inversion circuit NI1. The outputs Q of the flip-flops F0 to F5 are supplied to the NOR gate 54. An output from the NOR gate 54 is supplied to an inversion circuit NI0 of the backward counter CNTi and to the inversion circuit NI1.

An output from the inversion circuit NI1 is supplied to the analog switch ASWi, thereby conducting the analog switch ASWi when the analog switch ASWi output from the inversion circuit NI1 is at the high level. The analog switch ASWi is conducted, the reference voltage supplied to the line 42 to be applied to the corresponding source line Oi through the connection terminal Si, and is supplied to and held at the pixel electrodes P.

When even only one bit of the outputs Q of the flip-flops F0 to F5 which are included in the backward counter CNTi is logic "1" an output from the NOR gate 54 is at the low level. Hence, an output from the inversion circuit NI1 is at the high level, which keeps the analog switch ASWi conducted.

When the outputs Q of all flip-flops F0 to F5 become logic "0" an output from the NOR gate 54 changes to the high level, so that an output from the inversion circuit NI1 changes to the low level. As a result, the analog switch ASWi is cut off and the impedance at the source driver 37 as viewed from the output terminal Si is a high impedance.

At the same time, logic "1" outputted from the NOR gate 54 is supplied to NAND gate NG10 through the inversion circuit NI0, so that the gradation clock signal CLK is not supplied to the first flip-flop F0. This stops decreasing by the backward counter CNTi. This condition is maintained until the latch signal LS is inputted again.

A waveform diagram similar to that shown, for example, in FIG. 8 of the embodiments heretofore described is obtained in a manner as described above, based on which the operation is performed. Thus, the analog switch ASWi is maintained to be conducted until a count of the backward counter CNTi exceeds zero, i.e., until the count becomes 1, while the analog switch ASWi is cut off when the count becomes equal to or smaller than zero, i.e., when the count becomes zero in this embodiment.

Figure 16:
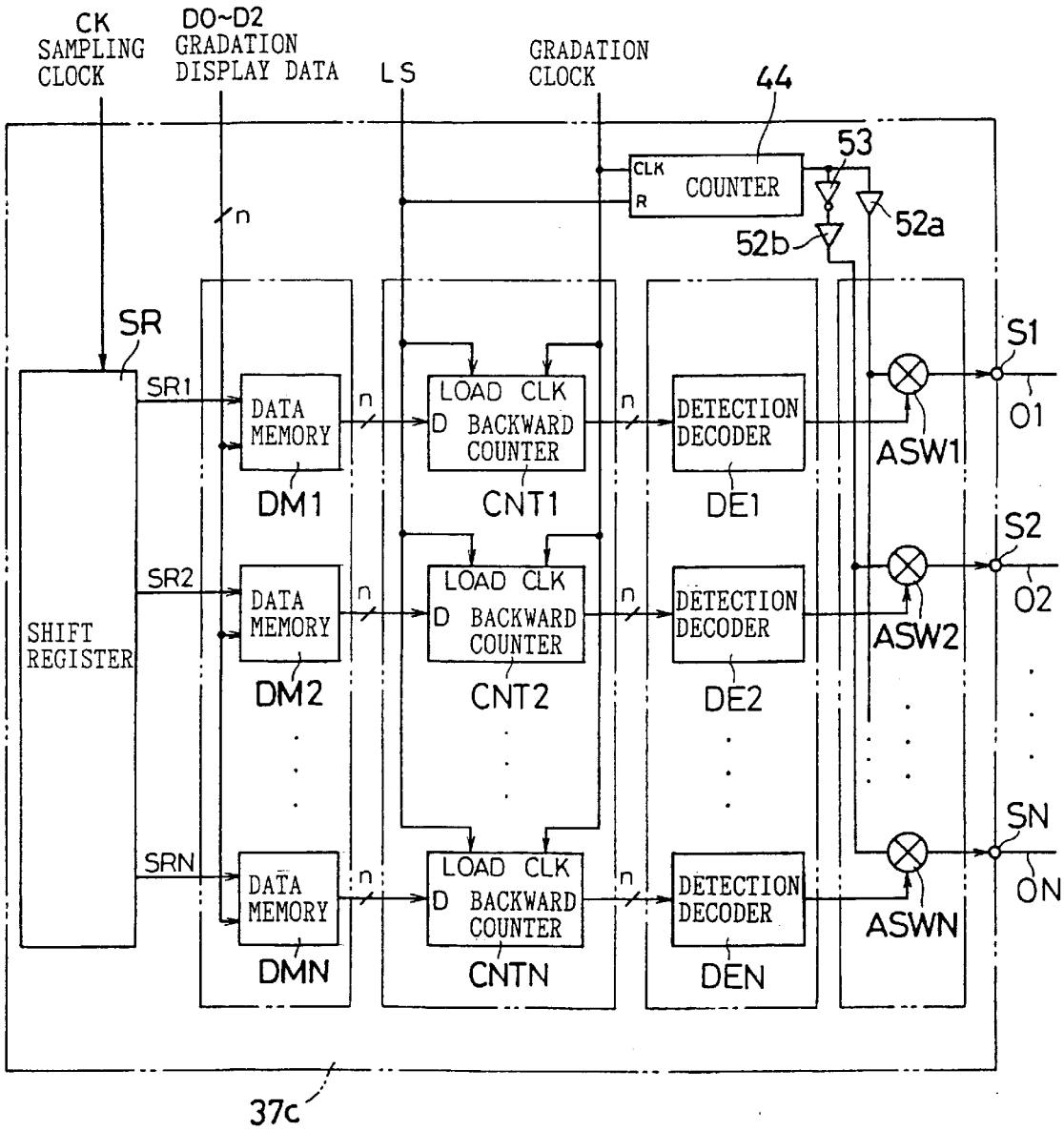
FIG. 16 is a block diagram showing a specific structure of a source driver 37*c* of a fifth embodiment of the invention.
Figure 17:
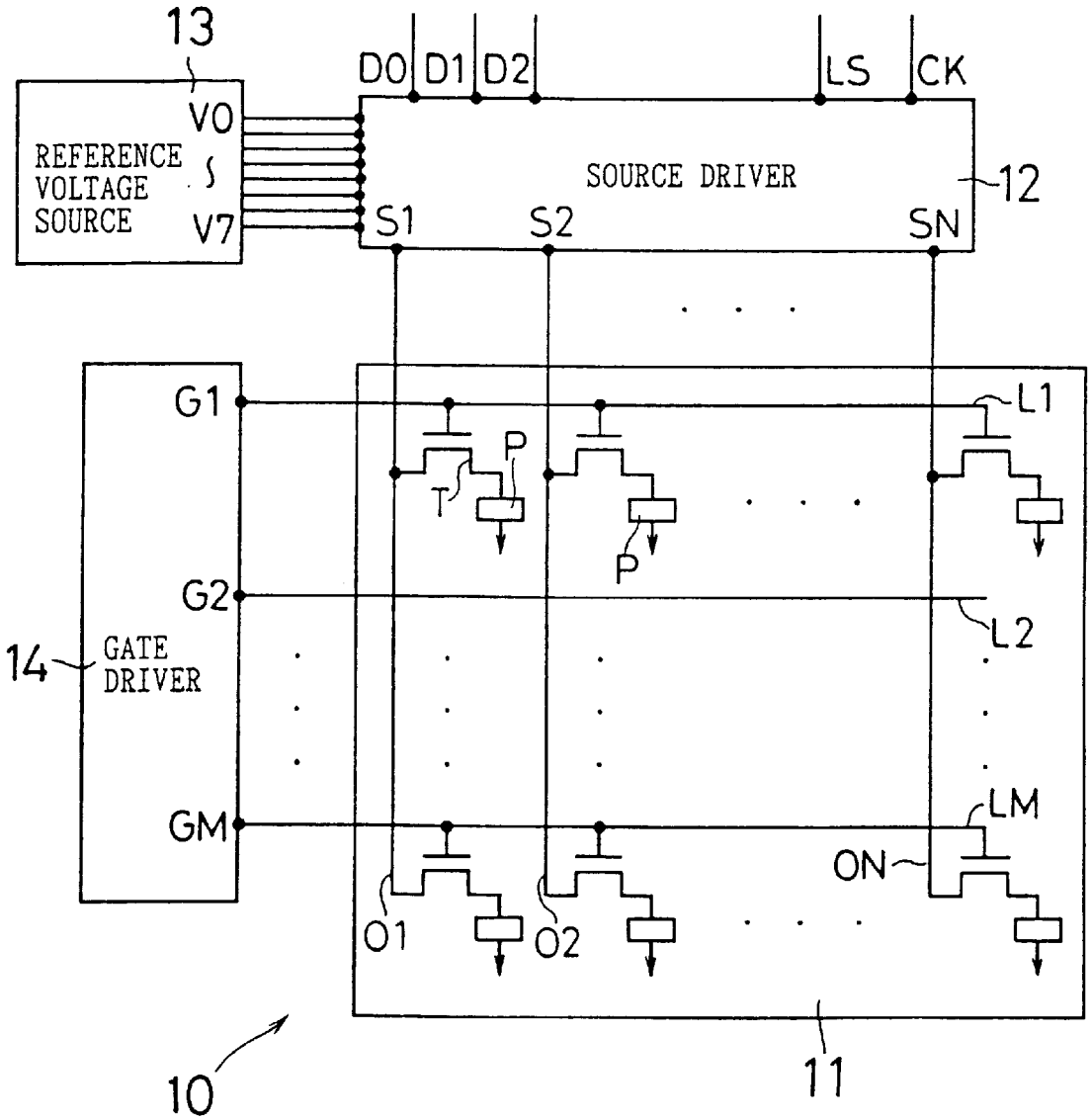
FIG.17 PRIOR ART
FIG. 17 is a schematic block diagram showing an overall structure of a first prior art display apparatus.
Figure 18:
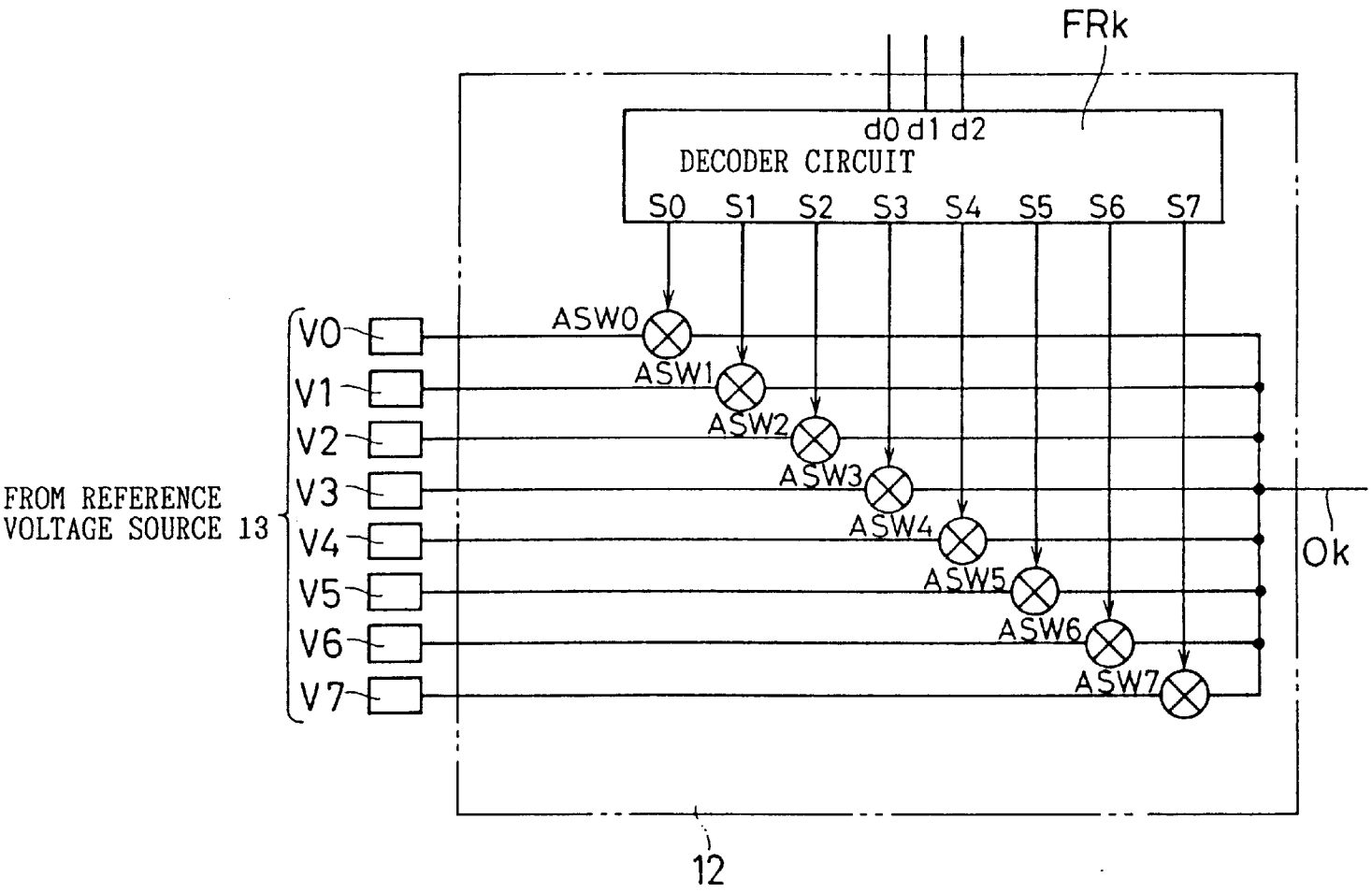
FIG.18 PRIOR ART
FIG. 18 is a block diagram specifically showing a partial structure of a source driver 12 which is shown in FIG. 17.
Figure 19:
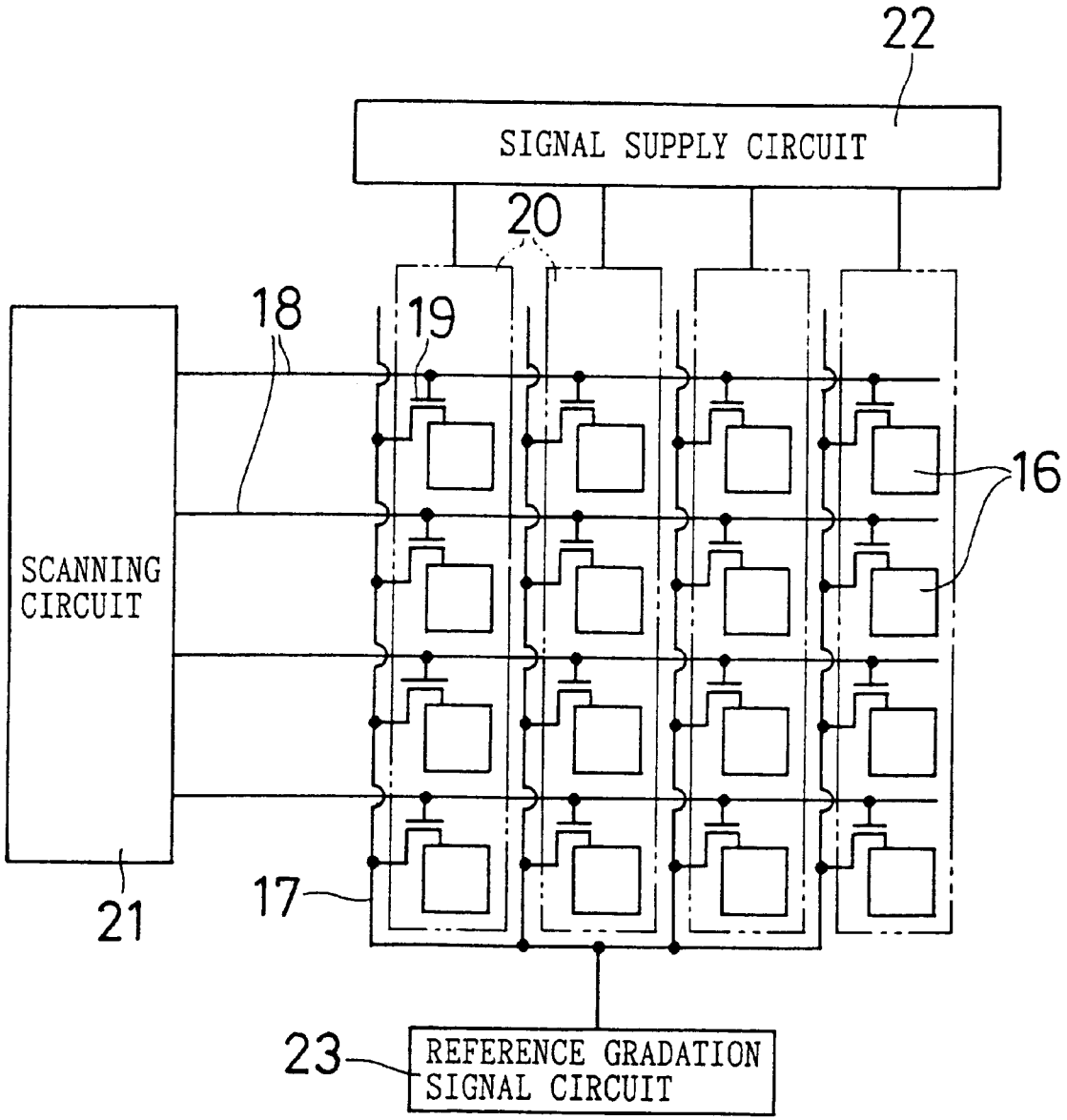
FIG.19 PRIOR ART
FIG. 19 is a schematic block diagram showing an overall structure of a second prior art display apparatus.
Figure 20:
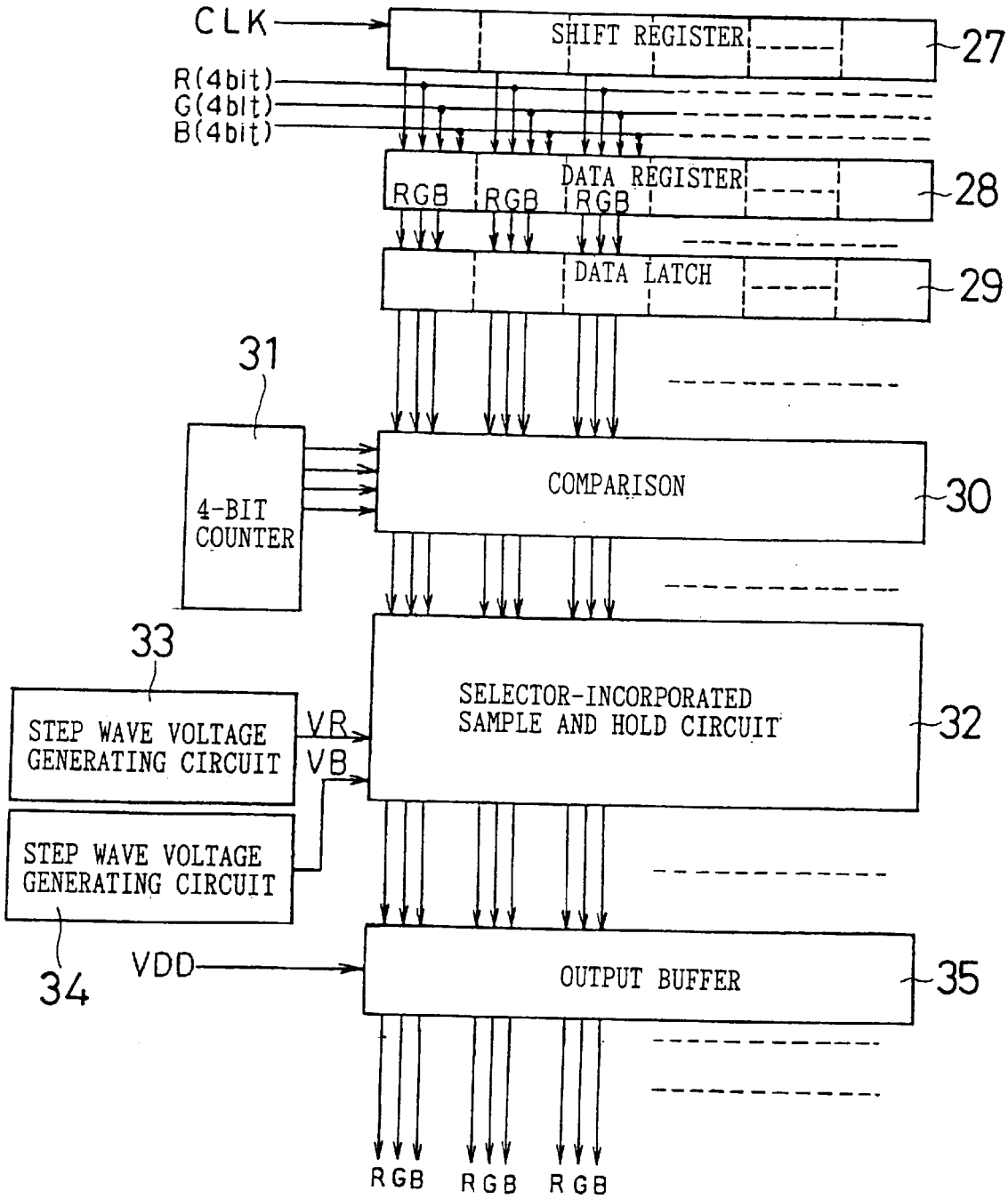
FIG. 20 PRIOR ART
FIG. 20 is a schematic block diagram showing a structure of a third prior art display apparatus.
Figure 21:
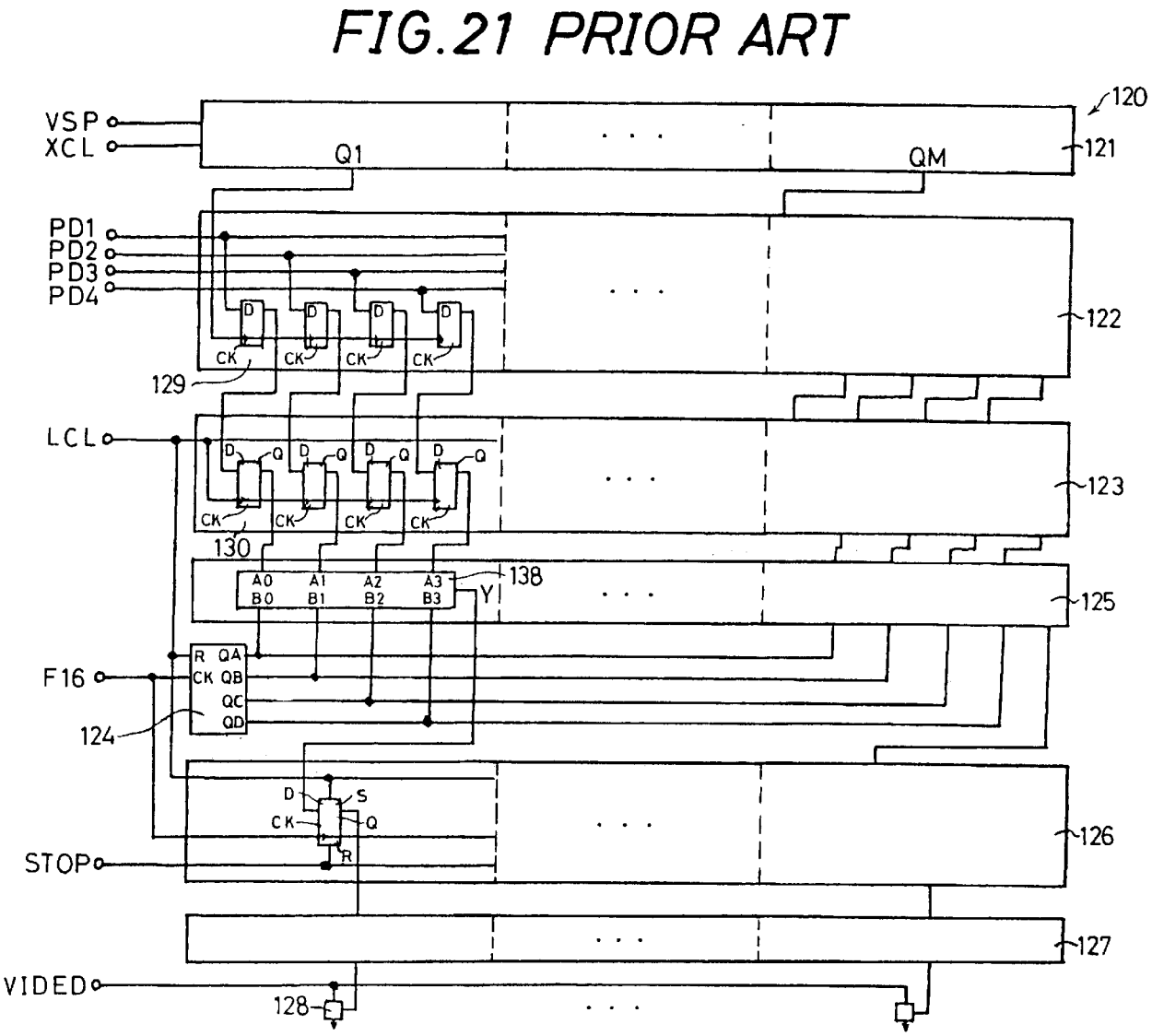
FIG. 21 PRIOR ART
FIG. 21 is a schematic block diagram showing a structure of a fourth prior art apparatus.
Figure 22:
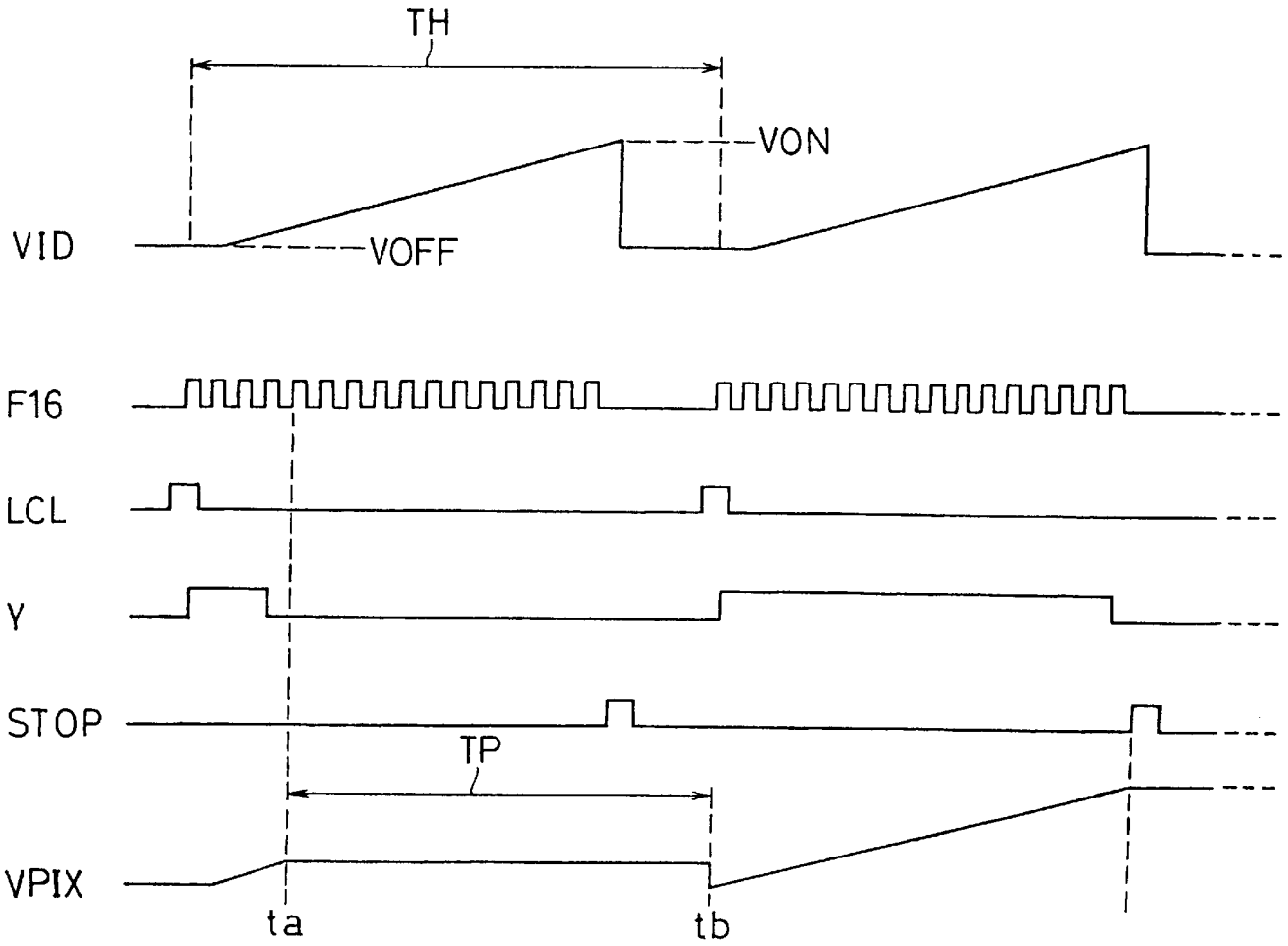
FIG.22 PRIOR ART
FIG. 22 is a waveform diagram for describing operation of the X-driver 120 shown in FIG. 20.

FIG. 16 is a block diagram showing a specific structure of a source driver 37*c* of a fifth embodiment of the present invention. This embodiment as well is similar to the embodiments heretofore described, and therefore, the same reference symbols are assigned to corresponding portions and a redundant description will be omitted.

In this embodiment, the analog switch ASWi is opened and closed under the control of the backward counter CNTi and the detection decoder DEi as in the fourth embodiment described immediately above. This embodiment is characterized in that the counter 44, the DACs 52*a* and 52*b* and the inverter 53 are disposed within the source driver 37*c* so that the source driver 37*c* internally generates the reference voltages as in the third embodiment described earlier.

In the source driver 37*c*, the counter 44 supplies an output to the DACs 52*a* and 52*b*. Outputs from the DACs 52*a* and 52*b* are supplied to the corresponding analog switches ASWi.

Thus, according to the fifth embodiment, since the reference voltages which are used for gradation display are generated within the source driver 37*c*, it is not necessary to dispose the terminals as those shown in FIG. 1 which receive the reference voltages from the reference voltage source 41. Hence, it is possible to reduce the number of the input terminals and to simplify the structure. The other structure is similar to those of the embodiments heretofore described.

Although the respective embodiments of the invention described above require that the reference voltage source 41 and the digital-to-analog convertor 52 are structured so as to generate a reference voltage whose level increases stepwise with time, as other embodiment of the invention, the reference voltage may decreases stepwise with time. In this case, the analog switch ASWi is constructed to conduct only during a predetermined period of time in response to outputs from the comparison circuit CMi and the detection decoder DEi. The predetermined period of time is defined as a time which is sufficient to apply voltages to the pixel electrodes P and hold the voltages at the pixel electrodes P.

While the foregoing has described the respective embodiments in relation to a case where 3-bit data are used as gradation display data to realize 8-level gradation display, it is possible to realize higher levels of gradation display when data consisting of more bits and an accordingly increased number of reference voltages are prepared.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of driving a display panel where gradation display is conducted by applying a voltage between a pair of electrodes facing each other through a dielectric layer, comprising:

generating a voltage having a plurality of voltage levels which increase stepwise with time at time intervals within a predetermined period and controlled by a clock signal, said predetermined period being equal to a horizontal scanning period and being based on a gradation clock signal in synchronization with said horizontal scanning period and said voltage being generated from a gradation data count and a reference voltage having a plurality of discrete voltage levels of constant amplitude increasing stepwise with time, the number of voltage levels of the reference voltage being equal to a maximum gradation data count;

applying each of said stepwise voltage levels of said generated voltage to said electrodes when their respective time intervals correspond to a time when a gradation clock signal has elapsed; and holding said generated voltage in said dielectric layer between said electrodes for the remaining horizontal scanning period.

2. The method of claim 1, further including:

generating a greater number of gradation clock signals than a number of gradation display data levels which are to be gradation-displayed sequentially with time at said intervals of said predetermined period;

counting said gradation clock signals;

applying said generated voltage to said electrodes at a time where a count equals a value corresponding to said number of gradation display data levels; and controlling said electrodes to hold said applied voltage.

3. A method of driving a display panel where gradation display is conducted by applying a voltage between a pair of electrodes facing each other through a dielectric layer, comprising:

generating a voltage having a plurality of voltage levels which increase stepwise with time at intervals of a predetermined period and controlled by a clock signal, said predetermined period being based on a gradation clock signal and said voltage being generated from a gradation data count and a reference voltage having a plurality of discrete voltage levels of constant amplitude increasing stepwise with time, the number of voltage levels of the reference voltage being equal to a maximum gradation data count;

applying each of said plurality of stepwise voltage levels of said generated voltage successively to said electrodes at said intervals, each of said voltage levels applied when a gradation clock signal has elapsed; and holding said generated voltage in the dielectric layer between said electrodes.

4. The method of claim 3, further including:

generating a greater number of gradation clock signals than a number of gradation display data levels which are to be gradation-displayed sequentially with time at said intervals of said predetermined period;

counting said gradation clock signals;

applying said generated voltage to said electrodes at a time where a count equals a value corresponding to said number of gradation display data electrodes, levels; and controlling said electrodes to hold the voltage.

5. A driving apparatus for conducting gradation display by applying a voltage supplied from a voltage source to a pair of electrodes through a dielectric layer, comprising:

a voltage applying switching element for controlling voltage applied to the electrodes;

a gradation display data generating device for generating a plurality of gradation display data levels at time intervals within a predetermined period and controlled by a clock signal;

a timing device for measuring time every period; and a switching element control device for controlling turning on and off of said voltage applying switching element in response to respective outputs from said gradation display data generating device and said timing device, wherein a voltage applied to said voltage applying switching element by the voltage source increases or decreases stepwise with each of said time intervals within said predetermined period, the voltage being generated from a gradation data count corresponding to a desired gradation display level and a reference voltage having a plurality of voltage levels of constant amplitude varying stepwise with time and in synchronism with said clock signal, the number of voltage levels of the reference voltage being equal to a maximum gradation data count.

6. The driving apparatus of claim 5, said timing device including a gradation clock signal generating device for generating a plurality of gradation clock signals in time sequence at equal intervals within said predetermined period, said number of gradation clock signals being greater than a number of gradation display data levels displayed gradationally during said predetermined period, and further including a counter for adding the gradation clock signals and yielding a count, and said switching element control device controlling turning on and off of said voltage applying switching element when a count of said counter equals a value corresponding to said number of gradation display data levels fed from said gradation display data generating device.

7. The driving apparatus of claim 6, said switching element control device allowing electrical conduction of said voltage applying switching element for a predetermined period when the count of said counter equals the value corresponding to said number of gradation display data levels, said switching element control device controlling said electrodes to hold said applied voltage during the time of electrical conduction.

8. The driving apparatus of claim 5, said timing device including a gradation clock signal generating device for generating gradation clock signals in time sequence at equal time intervals within said predetermined period, the number of the gradation clock signals being greater than a number of gradation display data levels which are to be displayed gradationally during said predetermined period, and said switching element control device including a backward counter for setting a value corresponding to said number of gradation display data, levels subtracting said value each time a gradation clock signal is received, wherein when a value of said backward counter reaches a predetermined count value, said switching element control device controls turning on and off of said voltage applying switching element.

9. The driving apparatus for driving a display panel of claim 5, wherein the timing means includes gradation clock signal generating means for generating gradation clock signals in time sequence at intervals of the predetermined period, the number of the gradation clock signals being larger than the number of gradation levels which are to be displayed gradationally during the predetermined period, and the switching element control means includes a backward counter for setting a value corresponding to the gradation display data at intervals of the predetermined intervals, and subtracting the value every time when a gradation clock signal is received, and when a value of the backward counter reaches a predetermined value, controls turning-on and -off of the voltage applying switching element.

10. The driving apparatus of claim 9, said switching element control device maintaining electrical conduction of said voltage applying switching element when the count of said backward counter is greater than said predetermined count value, and interrupting electrical conduction of said voltage applying switching element when the count of said backward counter is less than or equal to said predetermined count value.

11. The driving apparatus of claim 9, said switching element control device allowing electrical conduction of said voltage applying switching element for a predetermined period of time when the count of said backward counter equals said predetermined count value, controlling said electrodes to hold said applied voltage during the time of electrical conduction.

12. A driver for a display panel, comprising:

a shift register for receiving a plurality of successive clock signals to output corresponding memory control signals representing source lines between the driver and a plurality of pixel electrodes on the display panel;

a memory for receiving said memory control signals, and for storing a plurality of gradation display data corresponding to said received memory control signals;

a latch circuit for storing and latching each of said plurality of gradation display data to provide an output;

a comparison circuit for comparing said output from said latch circuit with an output from a counter representing a count of a plurality of gradation clock signals, said comparison circuit outputting a signal when said latch circuit output and counter output coincide; and a switch circuit for receiving said outputted signal from said comparison circuit to enable at least a portion of a reference voltage supplied thereto to be applied to said source lines and said pixel electrodes, wherein the reference voltage includes a plurality of discrete voltage levels of constant amplitude varying stepwise with time and in synchronism with said clock signals, the number of steps being equal to a maximum gradation clock count.

13. The driver of claim 12, further including a gradation clock generating circuit for generating a plurality of gradation clock signals within a predetermined period of time which are successively counted by said counter.

14. The driver of claim 12, said outputted signal from said comparison circuit controlling conduction and interruption of said reference voltage to said pixel electrodes.

15. The driver of claim 13, said reference voltage including a plurality of stepwise voltage levels which are successively applied at equal time intervals within said predetermined period to said switching circuit, each of said plurality of stepwise voltage level corresponding to a generated gradation clock signal and increasing with each elapsed gradation clock signal within said predetermined period, thereby providing a reference voltage waveform approximating a gamma correction curve to suppress deterioration of the liquid crystal.

16. The driver of claim 12, said reference voltage applied to said switch circuit including a first reference voltage increasing stepwise with time in a predetermined period, and a second reference voltage increasing or decreasing stepwise within said predetermined period in a direction opposite to said first reference voltage, said predetermined period based on said gradation clock signal.

17. The driver of claim 12, said latch circuit output representing a number of gradation data display levels input into said memory from a gradation display data generating device, said comparison circuit outputting a signal to said switch circuit when the number of gradation data display levels equals the number of gradation clock signals added by said counter to yield a count.

18. A method of driving a display, comprising:

providing a plurality of successive clock signals;

outputting memory control signals corresponding to said clock signals, said memory control signals representing source lines between a driver and a plurality of pixel electrodes on the display;

receiving said memory control signals in a memory;

storing a plurality of gradation display data corresponding to said received memory control signals in said memory;

latching each of said plurality of gradation display data in a latch circuit to provide an output;

comparing said output from said latch circuit with an output from a counter representing a count of a plurality of gradation clock signals; and outputting a signal when said latch circuit output and counter output coincide, said outputted signal controlling at least a portion of a reference voltage having a plurality of stepwise voltage levels to be applied to said source lines and said pixel electrodes, wherein the reference voltage includes a plurality of discrete voltage levels of constant amplitude varying stepwise with time and in synchronism with said clock signals, the number of steps being equal to a maximum gradation clock count.

19. The method of claim 18, further including generating a plurality of gradation clock signals successively counted by said counter within a predetermined period of time.

20. The method of claim 18, said outputted signal controlling conduction and interruption of said reference voltage to said pixel electrodes.

21. The method of claim 19, further including successively applying said plurality of stepwise voltage levels at equal time intervals within said predetermined period to said pixel electrodes, each of said plurality of stepwise voltage levels corresponding to a generated gradation clock signal and increasing with each elapsed gradation clock signal within said predetermined period, thereby providing a reference voltage waveform approximating a gamma correction curve to suppress deterioration of the display.

* * * * *